US009515409B2

(12) United States Patent
Masui et al.

(10) Patent No.: US 9,515,409 B2
(45) Date of Patent: Dec. 6, 2016

(54) COVER AND CONNECTION STRUCTURE OF HOUSING AND COVER

(71) Applicant: Yazaki Corporation, Tokyo (JP)

(72) Inventors: Yukari Masui, Makinohara (JP); Hisaya Shibata, Makinohara (JP); Hideki Homma, Tokyo (JP); Kouhei Wachi, Tokyo (JP); Masafumi Noguchi, Tokyo (JP); Hiroshi Miyazaki, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/951,881

(22) Filed: Nov. 25, 2015

(65) Prior Publication Data

US 2016/0156121 A1 Jun. 2, 2016

(30) Foreign Application Priority Data

Nov. 27, 2014 (JP) ..... 2014-240502

(51) Int. Cl.
*H01R 13/50* (2006.01)
*H01R 13/447* (2006.01)

(52) U.S. Cl.
CPC ..... *H01R 13/501* (2013.01); *H01R 13/447* (2013.01)

(58) Field of Classification Search
CPC ..... H01R 13/501; H01R 13/447
USPC ..... 439/892, 449, 501, 694, 881, 901, 854,439/855, 470–471, 596, 456, 465–467, 731
See application file for complete search history.

(56) References Cited

U.S. PATENT DOCUMENTS 5,897,392 A * 4/1999 Takahashi ..... B60R 16/0215 429/121
8,556,650 B2 * 10/2013 Ikeda ..... H01R 13/567 439/456
2014/0206242 A1 * 7/2014 Torii ..... H01R 13/639 439/731

FOREIGN PATENT DOCUMENTS

JP 2013-8561 A 1/2013

* cited by examiner

*Primary Examiner* — Edwin A. Leon
(74) *Attorney, Agent, or Firm* — Sughrue Mion, PLLC

(57) ABSTRACT

A cover includes a body attached to a housing containing a terminal connected to an electric wire, and that includes an electric wire leading portion, and a lid to be fitted to the body. The cover includes a guide receiving portion on an outer surface of a distal end of one of the lid and the body, and a guide portion on a distal end of the other. The guide receiving portion has an inclined surface inclined toward an inner surface of the guide receiving portion along a fitting direction. The guide portion guides a distal end of the guide receiving portion. The guide portion protrudes outward perpendicularly to the fitting direction. The guide portion has an inclined surface on an inner surface of the distal end of the other of the lid and the body.

5 Claims, 27 Drawing Sheets

COVER AND CONNECTION STRUCTURE OF HOUSING AND COVER

CROSS REFERENCE TO RELATED APPLICATION

This application is based on Japanese Patent Application (No. 2014-240502) filed on Nov. 27, 2014, the contents of which are incorporated herein by reference. Also, all the references cited herein are incorporated as a whole.

BACKGROUND OF THE INVENTION

1. Technical Field

The present invention relates to a cover including a body and a lid, and a connection structure of a housing and the cover.

2. Background Art

For example, a technique illustrated in FIG. 1 of JP-A-2013-8561 is conventionally used for a cover that protects electric wires placed into a connector housing and pulled out from the connector housing. A cover 10 illustrated in FIG. 1 of JP-A-2013-8561 is configured so that electric wires W placed into an electric wire pull-out portion of a connector housing 2 and pulled out from the connector housing 2 are led out through an electric wire container 14.

To provide a cover configured so that electric wires pulled out from a connector housing are led out using a technique different from that disclosed in JP-A-2013-8561, the inventors developed a cover illustrated in FIGS. 19 to 27.

A connector 100 illustrated in FIGS. 19 to 27 includes: a connector housing 101; a cover 102 to be fitted to the connector housing 101; a front holder 103; a sealing 104; a corrugated tube 105 (see FIG. 22); and electric wires 108 each having an end with a terminal (or a female terminal) 106 and a rubber stopper 107 attached thereto.

The connector housing 101 is internally provided with a cavity 109 configured to contain the terminals 106. As illustrated in FIG. 20, the connector housing 101 is provided at its rear surface with terminal insertion holes 110. With the terminals 106 contained in the cavity 109, the electric wires 108 are led out through the terminal insertion holes 110. Each terminal insertion hole 110 is sealed with the rubber stopper 107 attached to the end of the associated electric wire 108.

The front holder 103 has a shape conforming to a front holder container 124 to be disposed on the bottom wall of the cavity 109.

The sealing 104 is placeable on the front surface of the connector housing 101.

As illustrated in FIG. 19, the cover 102 includes a body 111, a lid 112, and a hinge 113. The cover 102 has a substantially tubular shape.

As illustrated in FIG. 19, the body 111 has a substantially tubular shape with openings at both ends. The peripheral edge of the rear opening of the body 111 is provided with a continuous electric wire leading portion 115. The opposite walls of the electric wire leading portion 115 are each provided with a first cover engaging portion 116 protruding therefrom. The peripheral edge of the rear opening of the body 111 is further provided with a second cover engaging portion 117.

As illustrated in FIG. 19, the lid 112 is arc-shaped in cross section, and configured to be able to cover the rear surface of the body 111. The lid 112 is provided with: first cover engaged portions 118 disposed to be engageable with the first cover engaging portions 116 of the body 111; and a second cover engaged portion 119 disposed to be engageable with the second cover engaging portion 117 of the body 111.

As illustrated in FIG. 19, the hinge 113 connecting the body 111 and the lid 112 serves as a pivot when the body 111 and the lid 112 are fitted to each other.

The procedure for assembling the connector 100 will now be described.

First, the terminal 106 placed on the end of each electric wire 108 is inserted into the cavity 109 through the associated terminal insertion hole 110 of the connector housing 101. This brings the terminal 106 into engagement with a lance 120 in the cavity 109 as illustrated in FIG. 20. Then, the front holder 103 is inserted into the front holder container 124 in the cavity 109.

Subsequently, the cover 102 is moved in the direction indicated by the arrow A in FIG. 20, thus inserting the connector housing 101 into the cover 102. The insertion of the connector housing 101 into the cover 102 is carried out until the front surface of the cover 102 (i.e., the surface indicated by the imaginary line C in FIG. 20) abuts against the front surface of the connector housing 101 (i.e., the surface indicated by the imaginary line B in FIG. 20) as illustrated in FIG. 21.

Subsequently, as illustrated in FIG. 22, the electric wires 108 led from the connector housing 101 are bent and inserted into the corrugated tube 105. An end of the corrugated tube 105 is assembled to the electric wire leading portion 115 of the body 111 of the cover 102. Then, using the hinge 113 as the pivot, the lid 112 of the cover 102 is rotated in the direction indicated by the arrow D in FIG. 22, so as to engage the first cover engaged portions 118 of the lid 112 with the first cover engaging portions 116 of the body 111, and to engage the second cover engaged portion 119 of the lid 112 with the second cover engaging portion 117 of the body 111. Thus, the body 111 and the lid 112 are fitted to each other. As a result of this procedure, the assembly of the connector 100 is completed.

The connector illustrated in FIGS. 19 to 27, however, has problems described below.

First, in rotating the lid 112 of the cover 102 in the direction indicated by the arrow D in FIG. 22 using the hinge 113 as the pivot, the hinge 113 may be distorted as illustrated in FIG. 23. Such distortion of the hinge 113 causes the first cover engaged portions 118 of the lid 112 to be out of proper engaging alignment with the first cover engaging portions 116 of the body 111. As illustrated in FIG. 24, this misalignment is likely to cause the distal end of the first cover engaged portion 118 of the lid 112 to abut against the corrugated tube 105. In view of this, in fitting the body 111 and the lid 112 of the cover 102 to each other, a worker has to carefully conduct the fitting operation so that the distal end of the first cover engaged portion 118 of the lid 112 will not abut against the corrugated tube 105 due to the distortion of the hinge 113. This unfortunately results in poor workability.

The hinge 113, which is prone to be distorted, disadvantageously causes a defective condition, such as breakage of the hinge 113, in addition to the above problems.

In inserting the terminal 106 into the cavity 109 of the connector housing 101 and engaging the terminal 106 with the lance 120, the terminal 106 may be inserted only halfway as illustrated in FIGS. 25A and 25B, and may be prevented from being disposed at a proper position illustrated in FIGS. 20 and 21. Such halfway insertion of the terminal 106 is detected on the basis of abutment of the distal end of a lance 121 of the front holder 103 against the distal end of the lance 120 of the cavity 109 when the front holder 106 not in full engagement with the connector housing 101 is pushed in the direction indicated by the arrow F in FIGS. 25A and 25B. The connector 100, however, requires fabrication of the front holder 106. This unfortunately increases the number of components and the number of assembly cycles, resulting in an increase in cost.

Fitting the connector 100 to a counterpart connector 200 illustrated in FIGS. 26 and 27 presents problems described below.

The connector 100 has many depth-direction backlashes between the connector housing 101, and the body 111 and lid 112 of the cover 102. These backlashes cause the connector housing 101 to move backward due to an insertion force exerted when an inclined surface 123 of an engaging arm 122 of the connector housing 101 is brought into sliding contact with an inclined surface 202 of an engaged portion 201 of a housing for the counterpart connector 200. As a result, a backlash indicated by the arrow G in FIG. 26 occurs. Fitting the connector 100 having the backlash G to the counterpart connector 200 causes the front surface of the cover 102 (i.e., the surface indicated by the imaginary line H in FIG. 26) to abut against a cover abutment surface 203 of the counterpart connector 200 before the engaging arm 122 of the connector housing 101 engages with the engaged portion 201 of the counterpart connector 200. This unfortunately results in inadequate engagement between the engaging arm 122 of the connector housing 101 and the engaged portion 201 of the counterpart connector 200. Such a problem hinders a reliable fit between the connector 100 and the counterpart connector 200, and eventually loosens the fit between the connector 100 and the counterpart connector 200.

SUMMARY

The present invention has been made in view of the above-described circumstances, and its object is to provide a cover that enhances workability, and a connection structure of a housing and the cover.

To solve the above problems, the present invention provides a cover including: a body configured to be attached to a housing containing a terminal connected to an end portion of an electric wire, the body being provided with an electric wire leading portion which leads out the electric wire pulled out from the housing; and a lid configured to be fitted to the body. A guide receiving portion is provided on an outer surface of a distal end of one of the lid and the body, the guide receiving portion being provided with an inclined surface inclined toward an inner surface of the guide receiving portion along a direction in which the lid and the body are fitted to each other; and a guide portion is provided on a distal end of the other of the lid and the body, the guide portion being configured to guide a distal end of the guide receiving portion, the guide portion protruding outward perpendicularly to the direction in which the lid and the body are fitted to each other, the guide portion being provided with an inclined surface on an inner surface of the distal end of the other of the lid and the body, the inclined surface of the guide portion being inclined outward along the direction in which the lid and the body are fitted to each other.

The inventive cover according to this embodiment includes the guide receiving portion on the outer surface of the distal end of one of the lid and the body. The cover is provided with the guide portion on the distal end of the other of the lid and the body. The guide receiving portion is provided with the inclined surface inclined toward the inner surface of the guide receiving portion along the direction in which the lid and the body are to be fitted to each other. The guide portion protrudes outward perpendicularly to the direction in which the lid and the body are to be fitted to each other. The guide portion is provided with the inclined surface on the inner surface of the distal end of the other of the lid and the body. The inclined surface of the guide portion is inclined outward along the direction in which the lid and the body are to be fitted to each other. Thus, the guide portion guides the distal end of the guide receiving portion when the lid and the body are fitted to each other.

For example, the cover according to the present invention is provided with a hinge connecting the body and the lid to each other. A portion of the hinge extending between one widthwise end of the hinge connected to the body and the other widthwise end of the hinge connected to the lid is protruded in a thickness direction of the hinge.

The inventive cover according to this embodiment increases the rigidity of the hinge, because the portion of the hinge extending between one widthwise end of the hinge connected to the body and the other widthwise end of the hinge connected to the lid is protruded in the thickness direction of the hinge. The hinge having such an protrusion portion has a longer total length than a hinge having no protrusion portion, thus enabling stress distribution.

For example, the lid of the cover according to the present invention is provided at its inner surface with an abutment portion configured to abut against a rubber stopper on the terminal when the body and the lid are fitted to each other.

The inventive cover according to this embodiment allows the abutment portion on the inner surface of the lid to abut against the rubber stopper on the terminal when the body and the lid are fitted to each other.

For example, the body of the inventive cover is provided with an engaging protrusion. The housing may be provided with an engaged portion configured to be engaged with the engaging protrusion.

The body of the inventive cover according to this embodiment is provided with the engaging protrusion. The housing is provided with the engaged portion engageable with the engaging protrusion. Thus, the engaging protrusion of the body of the cover comes into engagement with the engaged portion of the housing.

To solve the above problems, the present invention provides a connection structure of a housing and a cover, the connection structure includes: the housing configured to contain a terminal connected to an end of an electric wire; and the cover including a body configured to be fitted to the housing and configured to lead out the electric wire pulled out from the housing, and a lid configured to be engaged with the body. A guide receiving portion is provided on an outer surface of a distal end of one of the lid and the body of the cover, the guide receiving portion being provided with an inclined surface inclined toward an inner surface of the guide receiving portion along a direction in which the lid and the body are brought into engagement with each other; and a guide portion is provided on a distal end of the other of the lid and the body, the guide portion being configured to guide a distal end of the guide receiving portion, the guide portion protruding outward perpendicularly to the direction in which the lid and the body are brought into engagement with each other, the guide portion being provided with an inclined surface on an inner surface of the distal end of the other of the lid and the body, the inclined surface of the guide portion being inclined outward along the direction in which the lid and the body are to be brought into engagement with each other.

The connection structure according to this embodiment is provided with: the guide receiving portion on the outer surface of the distal end of one of the lid and the body of the cover; and the guide portion on the distal end of the other of the lid and the body. The guide receiving portion is provided with the inclined surface inclined toward the inner surface of the guide receiving portion along the direction in which the lid and the body are to be brought into engagement with each other. The guide portion protrudes outward perpendicularly to the direction in which the lid and the body are to be fitted to each other. The guide portion is provided with the inclined surface on the inner surface of the distal end of the other of the lid and the body. The inclined surface of the guide portion is inclined outward along the direction in which the lid and the body are to be brought into engagement with each other. Thus, the guide portion guides the distal end of the guide receiving portion when the lid is brought into engagement with the body of the cover after the housing is fitted to the body.

In fitting the lid and the body to each other, the present invention allows the guide portion to guide the distal end of the guide receiving portion. Thus, the distal end of the lid is unlikely to abut against the electric wire. This means that the body and the lid of the cover are fitted to each other without exercising care to prevent abutment of the distal end of the lid against the electric wire. Consequently, the present invention has the effect of enhancing the workability of fitting the body and the lid to each other.

According to the present invention, the guide receiving portion is provided on one of the lid and the body. Thus, the surface of abutment between the guide receiving portion and the inner surface of the other of the lid and the body is larger than when no guide receiving portion is provided. This prevents distortion of the cover caused by harness tension. Consequently, the present invention has the effect of preventing distortion-induced disengagement of the cover from the housing.

The present invention increases the rigidity of the hinge so as to prevent distortion of the hinge and fit the lid and the body to each other at proper fit positions. Thus, in fitting the lid and the body to each other, the distal end of the lid is more unlikely to abut against the electric wire. This means that the body and the lid of the cover are fitted to each other without exercising care to prevent abutment of the distal end of the lid against the electric wire. Consequently, the present invention has the effect of further enhancing the workability of fitting the body and the lid to each other.

According to the present invention, the portion of the hinge, extending between one widthwise end of the hinge connected to the body and the other widthwise end of the hinge connected to the lid, is protruded in the thickness direction of the hinge. Accordingly, the hinge provided with such an protrusion portion has a longer total length than a hinge provided with no protrusion portion, thus enabling stress distribution. This prevents distortion of the hinge. Consequently, the present invention has the effect of preventing distortion-induced breakage of the hinge.

According to the present invention, in fitting the lid to the body, with the terminal inserted halfway through the cavity of the housing, the abutment portion presses the rubber stopper, thus bringing the terminal to a proper position in the cavity. Consequently, the present invention has the effect of preventing a situation where the terminal is inserted only halfway.

According to the present invention, in fitting the lid to the body, halfway insertion of the terminal is detected by pressing of the rubber stopper by the abutment portion. This eliminates the need for any front holder. Accordingly, the present invention reduces the number of components and the number of assembly cycles, and thus has the effect of reducing cost.

According to the present invention, once the lid is fitted to the body, the abutment portion constantly presses the rubber stopper. Thus, the present invention will prevent backlash of the cover if the connector is vibrated. Consequently, the present invention has the effect of preventing generation of unusual noises caused by backlash of the cover.

According to the present invention, the engaging protrusion of the body of the cover comes into engagement with the engaged portion of the housing so as to allow the body of the cover to be in provisional engagement with the housing. Thus, backlash in the depth direction occurs only between two components, i.e., the housing and the cover, so that no further backlash in the depth direction will occur when the lid is fitted to the body. Accordingly, when the front surface of the cover abuts against a cover abutment surface of a counterpart connector, the engaging protrusion of the body of the cover is in engagement with the engaged portion of the housing, thus preventing the housing from moving backward. Consequently, the present invention has the effect of reducing depth-direction backlash, thus reliably bringing an engaging portion of the connector into engagement with an engaged portion of the counterpart connector.

The present invention further has the effect of reliably fitting the connector to the counterpart connector, thus preventing loosening of the fit between the connector and the counterpart connector.

When the housing is fitted to the body of the cover and the lid is brought into engagement with the body, the present invention allows the guide portion to guide the distal end of the guide receiving portion. Thus, the body and the lid of the cover are brought into engagement with each other without exercising care to prevent abutment of the distal end of the lid against the electric wire. Consequently, the present invention has the effect of providing the connection structure that enhances the workability of bringing the body and the lid of the cover into engagement with each other when the housing is fitted to the body of the cover and then the lid is brought into engagement with the body.

According to the present invention, the guide receiving portion is provided on the other of the lid and the body. Thus, the surface of abutment between the guide receiving portion and the inner surface of one of the lid and the body is larger than when no guide receiving portion is provided. This prevents distortion of the cover caused by harness tension. Consequently, the present invention has the effect of providing the connection structure that prevents distortion-induced disengagement of the cover from the housing.

DETAILED DESCRIPTION OF THE EXEMPLARY EMBODIMENTS

A cover according to Embodiment 1 of the present invention will be described below with reference to FIGS. 1 to 8. A cover according to Embodiment 2 of the present invention will be described below with reference to FIGS. 9A and 9B. A cover according to Embodiment 3 of the present invention will be described below with reference to FIGS. 10 to 13. A cover according to Embodiment 4 of the present invention will be described below with reference to FIGS. 14 to 18.

Embodiment 1

Figure 1:
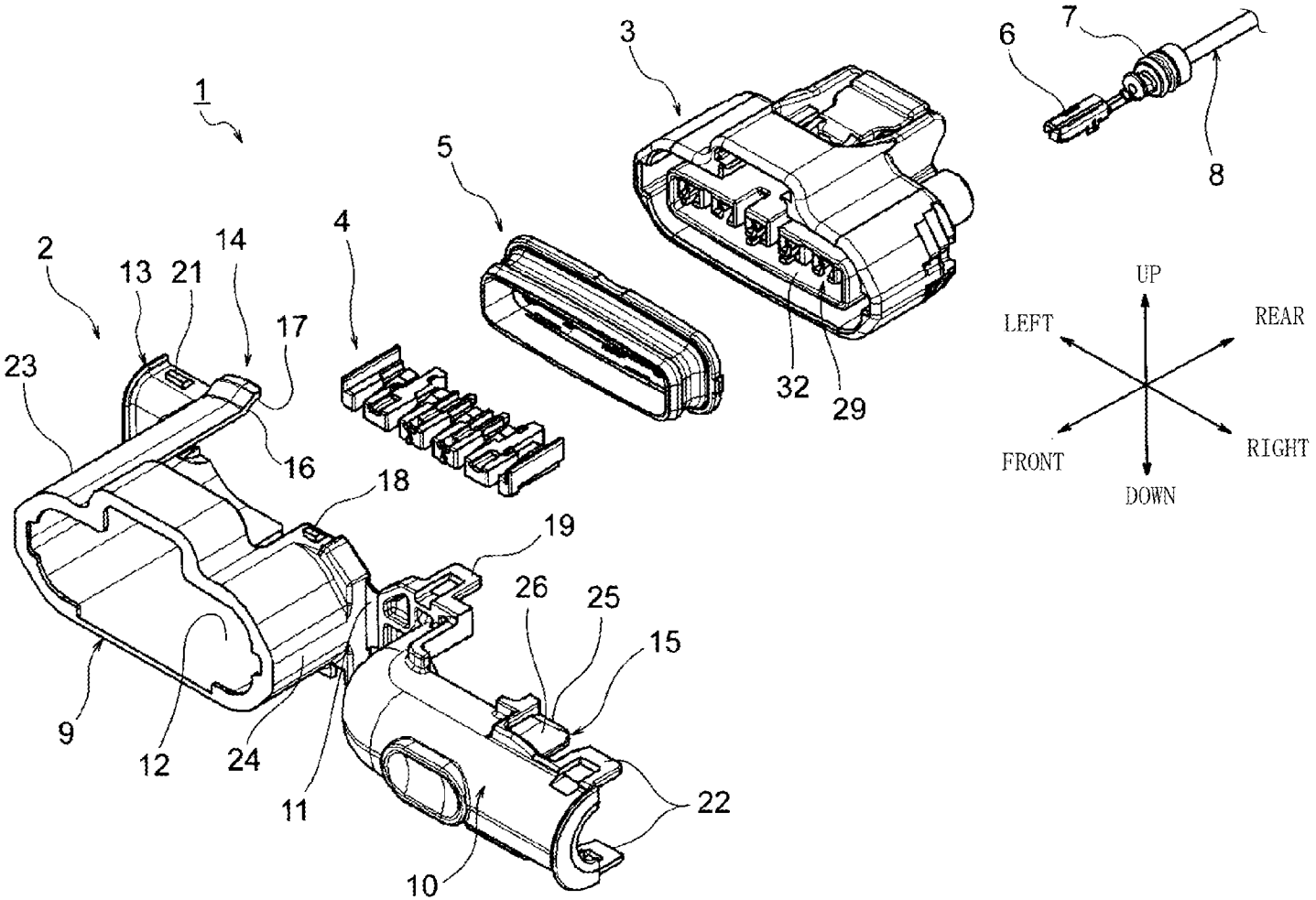
FIG. 1 is an exploded perspective view of a connector according to Embodiment 1 of the present invention, including an inventive cover.
Figure 2:
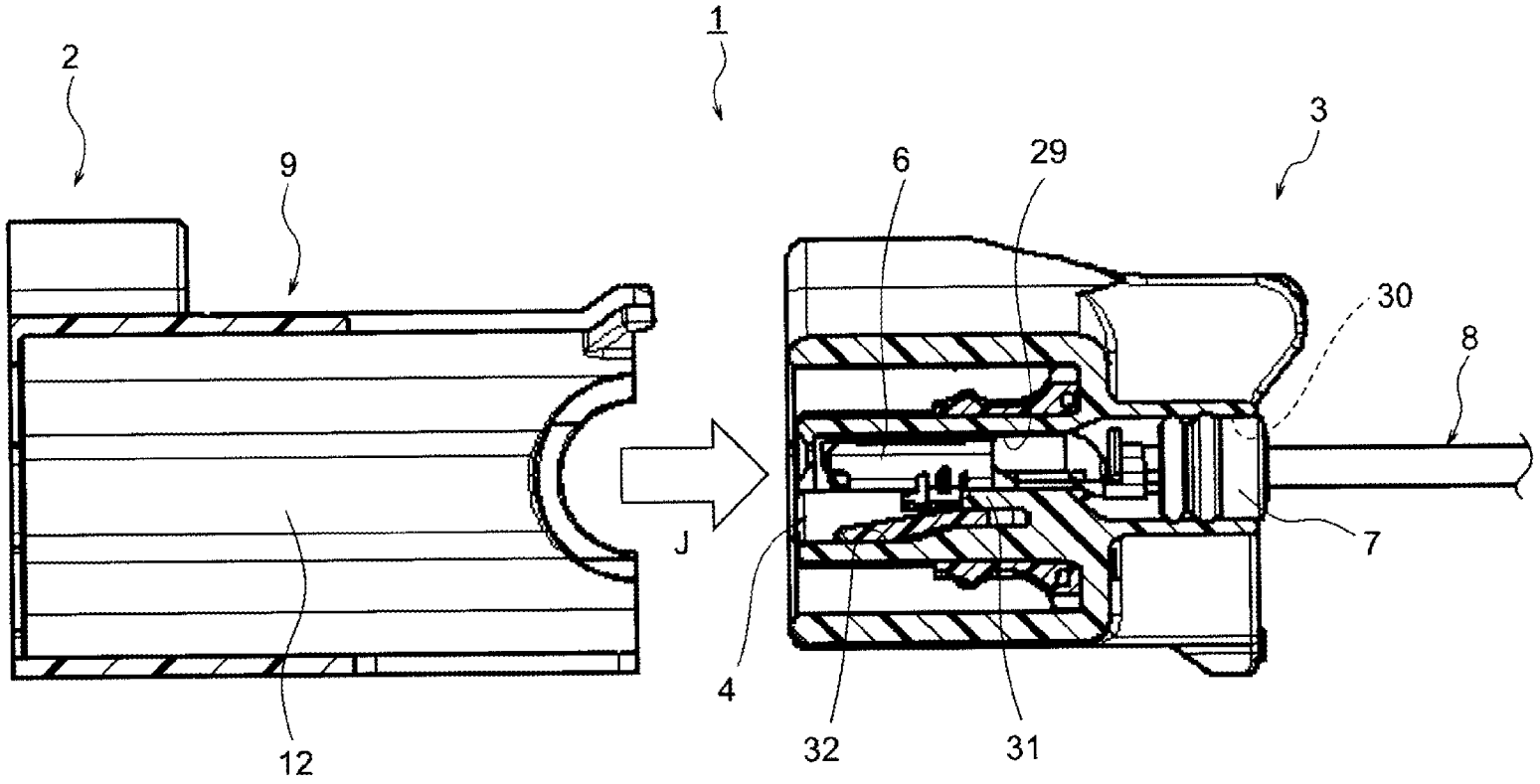
FIG. 2 is a cross-sectional view of the cover and a housing, illustrating how the cover and the housing are assembled to each other.
Figure 3:
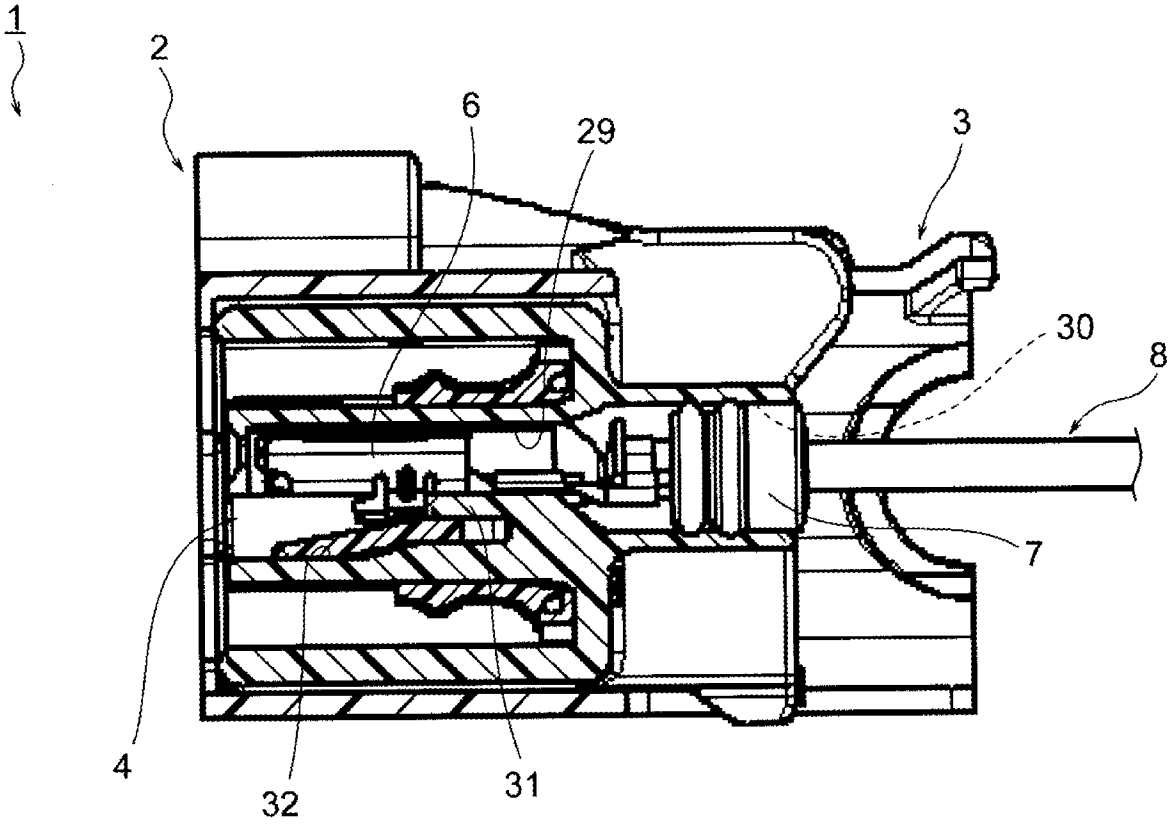
FIG. 3 is a cross-sectional view of the cover and housing assembled to each other.
Figure 4:
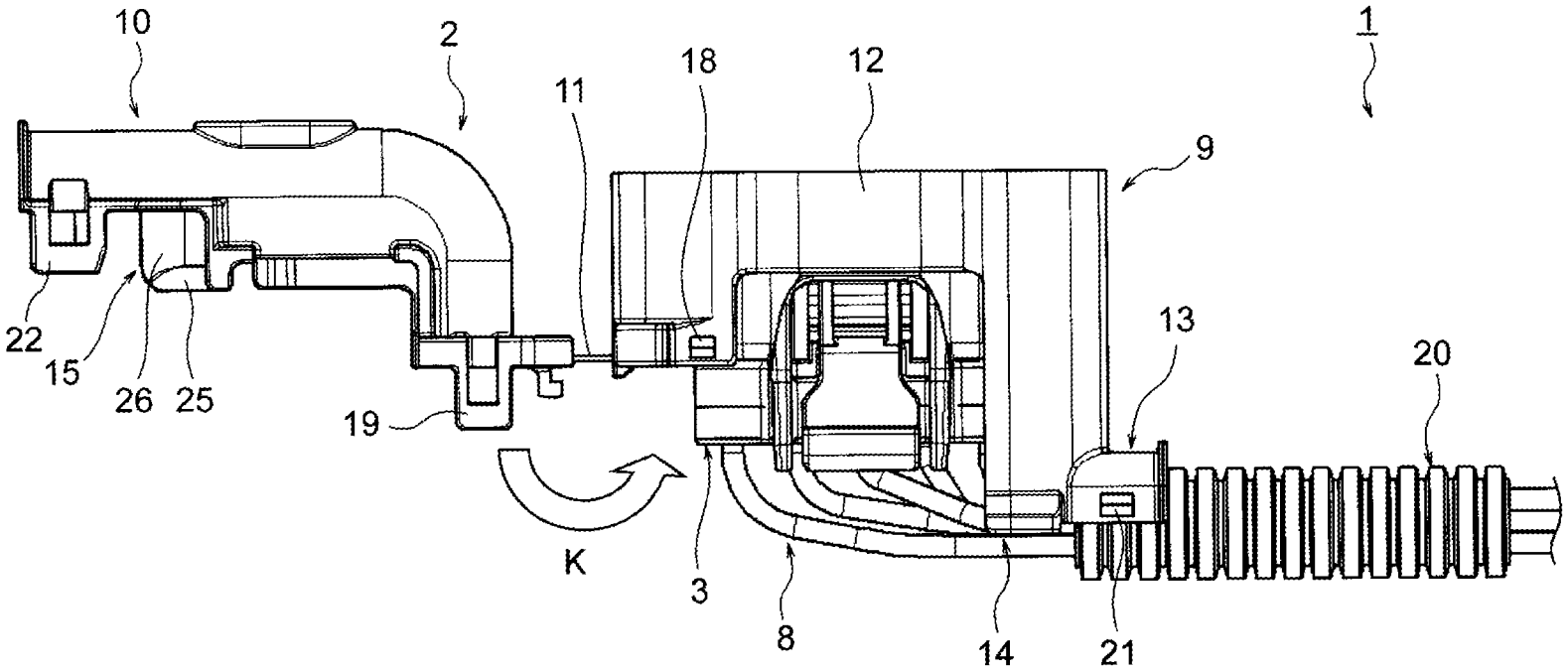
FIG. 4 is a plan view of the connector, illustrating how the body and lid of the cover are fitted to each other.
Figure 5:
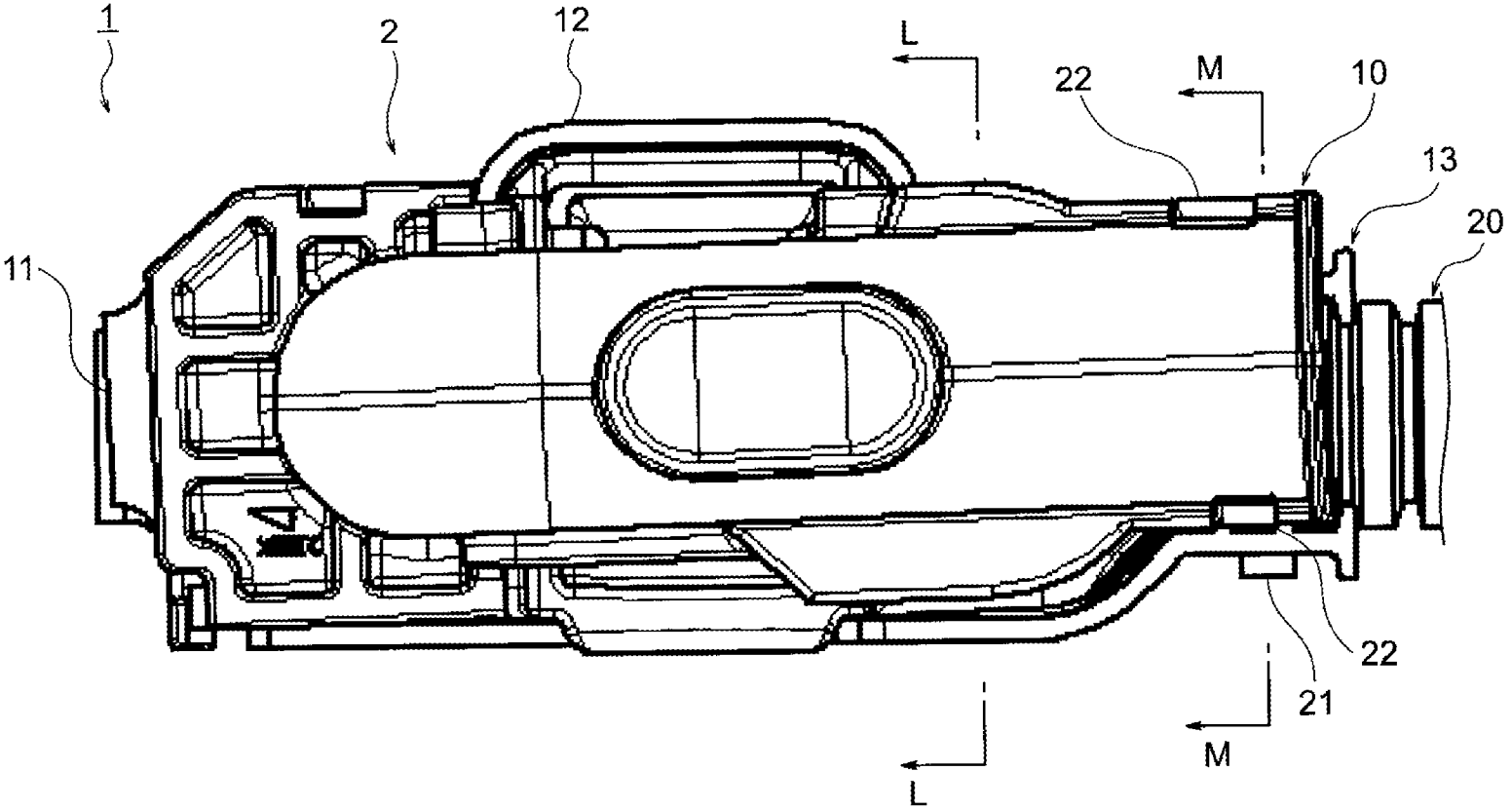
FIG. 5 is a side view of the connector viewed from the lid of the cover, illustrating how the body and lid of the cover are fitted to each other.
Figure 6:
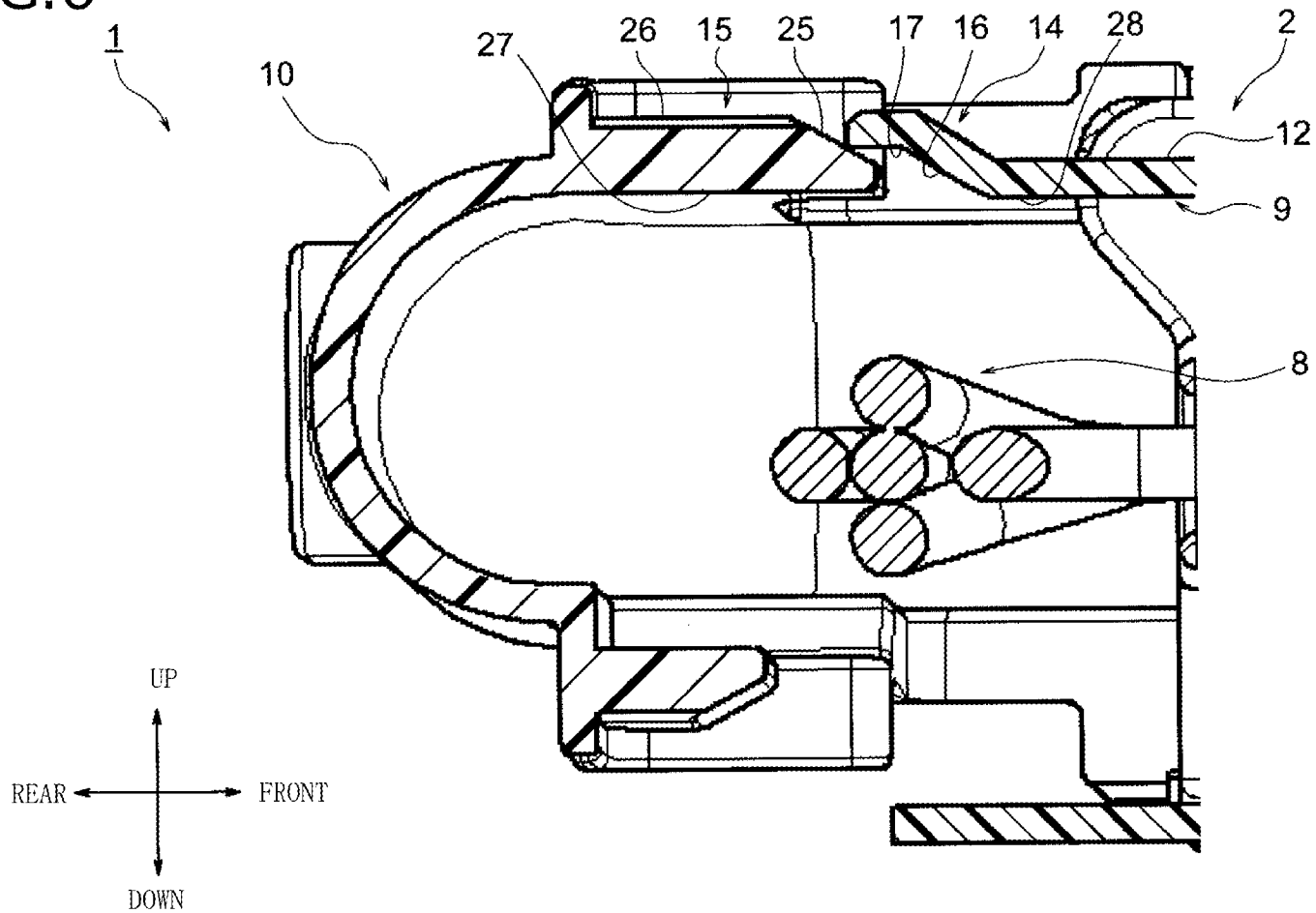
FIG. 6 is a cross-sectional view taken along the line L-L in FIG. 5.
Figure 7:
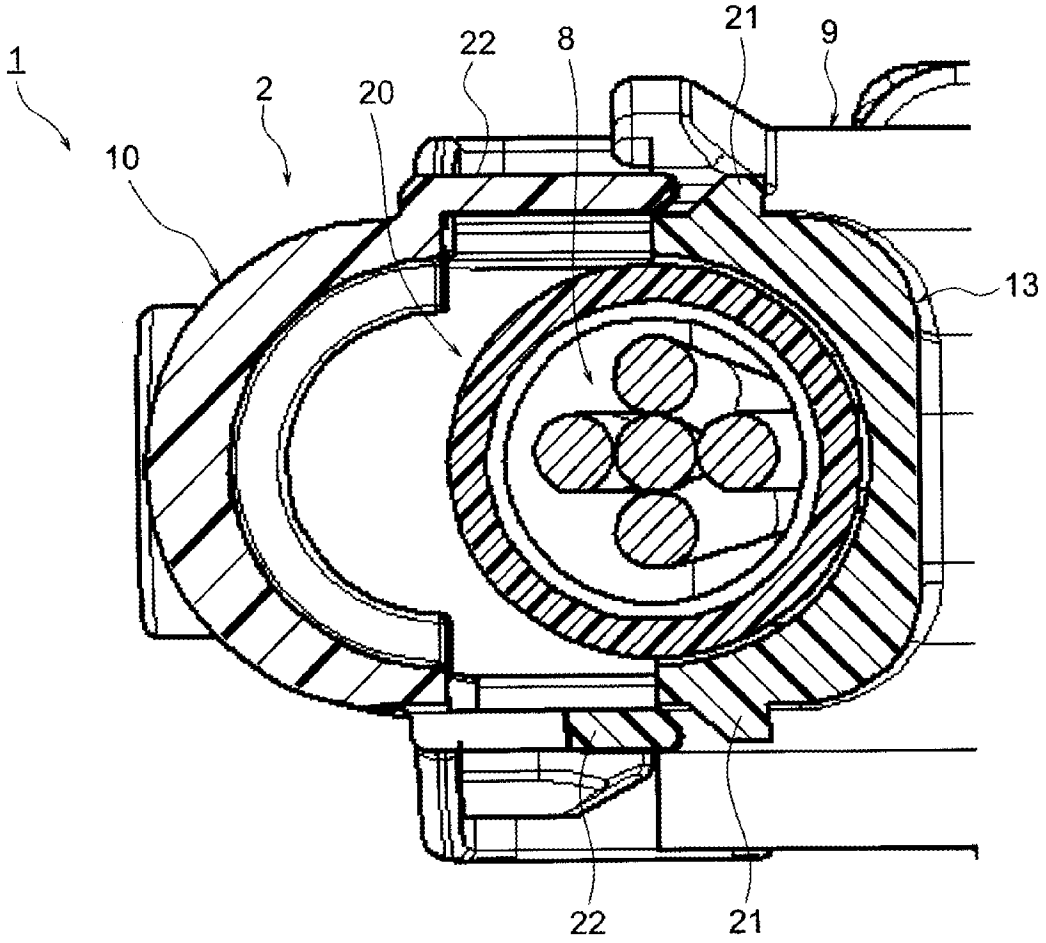
FIG. 7 is a cross-sectional view taken along the line M-M in FIG. 5.
Figure 8:
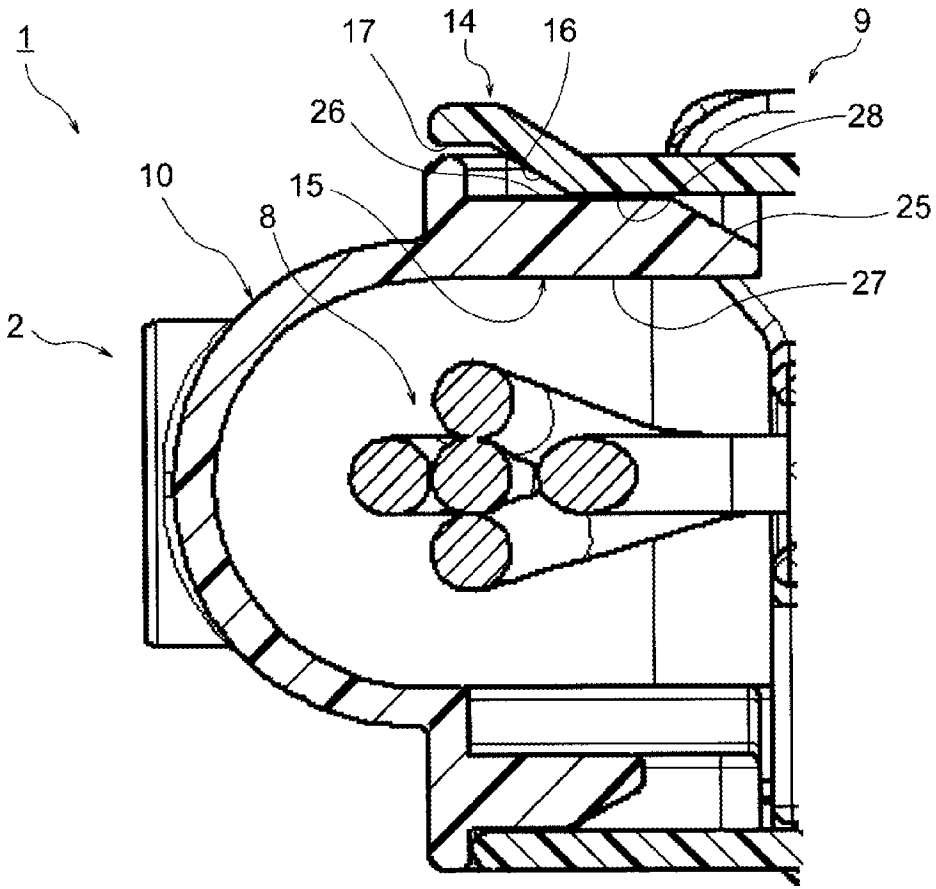
FIG. 8 is a cross-sectional view taken along the line L-L in FIG. 5, with the body and lid of the cover fitted to each other.

Embodiment 1 will now be described with reference to the drawings. FIG. 1 is an exploded perspective view of a connector according to Embodiment 1 of the present invention, including an inventive cover and serving as a connection structure. FIG. 2 is a cross-sectional view of the cover and a housing, illustrating how the cover and the housing are assembled to each other. FIG. 3 is a cross-sectional view of the cover and the housing assembled to each other. FIG. 4 is a plan view of the connector, illustrating how the body and lid of the cover are fitted to each other. FIG. 5 is a side view of the connector viewed from the lid of the cover, illustrating how the body and lid of the cover are fitted to each other. FIG. 6 is a cross-sectional view taken along the line L-L in FIG. 5. FIG. 7 is a cross-sectional view taken along the line M-M in FIG. 5. FIG. 8 is a cross-sectional view taken along the line L-L in FIG. 5, with the body and lid of the cover fitted to each other.

The arrows in the drawings indicate, by way of example, forward, rearward, upward, downward, leftward, and rightward directions.

Reference sign 1 in FIG. 1 denotes a connector serving as a connection structure according to the present invention. The connector 1 is not limited to any particular connector. In the present embodiment, the connector 1 is a female connector.

The connector 1 includes: a cover 2 according to the present invention; a housing 3; a front holder 4; a sealing 5; electric wires 8 each having an end with a terminal 6 and a rubber stopper 7 attached thereto; and a corrugated tube 20 (see FIG. 4). Each of these components will be described below.

First, the cover 2 according to the present invention will be described.

As illustrated in FIG. 1, the cover 2 includes a body 9, a lid 10, and a hinge 11.

As illustrated in FIG. 1, the body 9 includes a housing container 12, and an electric wire leading portion 13. The housing container 12 has a tubular shape and is substantially elliptical in cross section, with the front and rear surfaces of the housing container 12 each having an opening. The housing container 12 is configured to be able to contain the housing 3.

A guide portion 14 and a first cover engaging portion 18 are each provided at a predetermined location of the rear peripheral edge of the housing container 12.

As illustrated in FIG. 1, the guide portion 14 is provided close to the electric wire leading portion 13 of the body 9 in the present embodiment. The position of the guide portion 14 is not limited to the position close to the electric wire leading portion 13. In one example, the guide portion 14 may be provided close to, for example, the hinge 11 (which will be described below).

The guide portion 14 serves to guide a guide receiving portion 15 (which will be described below) when the body 9 and the lid 10 are fitted to each other. The guide portion 14 protrudes outward (i.e., upward in FIG. 1) substantially perpendicularly to the direction in which the body 9 and the lid 10 are to be fitted to each other (i.e., the front-rear direction in FIG. 1). As illustrated in FIGS. 6 and 8, the guide portion 14 protrudes outward in the manner just described so as to be able to come into contact with the guide receiving portion 15 (which will be described below) if the lid 10 is out of proper fitting alignment with the body 9.

As illustrated in FIGS. 1 and 6, the guide portion 14 is provided at its inner surface with a guide inclined surface 16 and a surface 17 parallel to the axis of the body.

The guide inclined surface 16 is equivalent to a "inclined surface" of a guide portion in the claims, and will hereinafter be referred to as a "guide inclined surface". The guide inclined surface 16 is brought into sliding contact with the distal end of the guide receiving portion 15 (which will be described below). The guide inclined surface 16 inclines outward (i.e., upward in FIGS. 1 and 6) along the direction in which the body 9 and the lid 10 are to be fitted to each other (i.e., the front-rear direction in FIGS. 1 and 6).

The surface 17 parallel to the axis of the body comes into contact with the guide receiving portion 15 (which will be described below) when the lid 10 is fitted to the body 9, with the lid 10 out of proper fitting alignment with the body 9. The surface 17, which is parallel to the axis of the body 9 (i.e., the front-rear direction in FIGS. 1 and 6), is continuous with the distal end of the guide inclined surface 16.

As illustrated in FIG. 1, the first cover engaging portion 18 is provided close to the hinge 11 in the present embodiment. The position of the first cover engaging portion 18 is not limited to the position close to the hinge 11. The first cover engaging portion 18 is engageable with a first cover engaged portion 19 (which will be described below).

As illustrated in FIG. 1, the electric wire leading portion 13 is continuous with the rear surface of a left side portion 23 of the housing container 12, and protruded perpendicularly to the axis of the body 9 (i.e., the front-rear direction in FIG. 1). As illustrated in FIG. 7, the electric wire leading portion 13 is substantially U-shaped in cross section. As illustrated in FIG. 4, an end portion of the corrugated tube 20 is attached to the electric wire leading portion 13. Although not illustrated in detail, the electric wire leading portion 13 is provided at its inner surface with a plurality of grooves to which a portion of the corrugated tube 20 associated with the electric wire leading portion 13 is to be attached. The grooves conform in shape to the bellows-like outer surface of the corrugated tube 20.

As illustrated in FIG. 7, the opposite walls of the electric wire leading portion 13 are provided at their outer surfaces with second cover engaging portions 21. The second cover engaging portions 21 are engageable with second cover engaged portions 22 (which will be described below).

As illustrated in FIG. 1, the lid 10 is substantially arc-shaped in cross section so as to be able to cover the rear surface of the body 9 when the lid 10 is fitted to the body 9.

The lid 10 is provided with the guide receiving portion 15, the first cover engaged portion 19, and the second cover engaged portions 22.

As illustrated in FIGS. 1 and 6, the guide receiving portion 15 is a plate-like portion protruding from the distal end of one of opposite portions of the lid 10 in the direction in which the body 9 and the lid 10 are to be fitted to each other (i.e., in the front-rear direction in FIGS. 1 and 6). The guide receiving portion 15 is provided at its outer surface with a guide receiving portion inclined surface 25 and a guide receiving portion abutment surface 26.

The guide receiving portion inclined surface 25 is equivalent to a "inclined surface" of a guide receiving portion in the claims, and will hereinafter be referred to as a "guide receiving portion inclined surface". The guide receiving portion inclined surface 25 is provided at the distal end of the guide receiving portion 15. The guide receiving portion inclined surface 25 is inclined toward an inner surface 27 of the guide receiving portion 15 along the direction in which the body 9 and the lid 10 are to be fitted to each other (i.e., the front-rear direction in FIGS. 1 and 6).

The guide receiving portion abutment surface 26 is provided at the base end of the guide receiving portion 15. The guide receiving portion abutment surface 26 is configured to abut against the inner surface of the housing container 12 of the body 9 when the body 9 and the lid 10 are fitted to each other. The inner surface of the housing container 12 will hereinafter be referred to as a "housing container abutment surface 28".

As illustrated in FIG. 1, the first cover engaged portion 19 is provided close to the hinge 11 and engageable with the first cover engaging portion 18 on the housing container 12 of the body 9.

As illustrated in FIG. 1, the second cover engaged portions 22 are provided at positions corresponding to those of the second cover engaging portions on the electric wire leading portion 13 of the body 9 when the body 9 and the lid 10 are fitted to each other. The second cover engaged portions 22 are engageable with the second cover engaging portions.

Although not illustrated in detail, a plurality of grooves to which a portion of the corrugated tube 20 associated with the lid 10 is to be attached are provided at a portion of the inner surface of the lid 10 located opposite to the inner surface of the electric wire leading portion 13 of the body 9 when the body 9 and the lid 10 are fitted to each other. The grooves conform in shape to the bellows-like outer surface of the corrugated tube 20.

As illustrated in FIG. 1, the hinge 11 is continuous with the rear surface of a right side portion 24 of the housing container 12, and serves as a connection between the body 9 and the lid 10. In the present embodiment, the hinge 11 serves as a pivot to allow the lid 10 to rotate such that the body 9 and the lid 10 are fitted to each other.

The housing 3 will now be described.

As illustrated in FIGS. 1 to 3, the housing 3 is configured to be assembled into the housing container 12 of the body 9 of the cover 2. The housing 3 is provided with a cavity 29 configured so as to be able to contain the terminal 6. As illustrated in FIGS. 2 and 3, the cavity 29 is provided with a cavity lance 31 engageable with the terminal 6. The cavity 29 is provided at its bottom wall with a front holder container 32 configured to contain the front holder 4.

The front surface of the housing 3 has an opening that serves as a connector fit portion to which a male connector is to be fitted, and that is in communication with the cavity 29. As illustrated in FIGS. 2 and 3, the rear surface of the housing 3 includes an opening serving as a terminal insertion hole 30 through which the terminal 6 is to be inserted into the cavity 29. The terminal insertion hole 30 is in communication with the cavity 29.

The front holder 4 will now be described.

The front holder 4 has a plate-like or comb-like shape conforming to the front holder container 32 in the cavity 29. In the present embodiment, the front holder 4 has a comb-like shape.

Next, the sealing 5 will be described.

The sealing 5 has a substantially annular shape so as to be placeable on the front surface of the housing 3.

The electric wires 8 will now be described.

Because known electric wires are used as the electric wires 8, detailed description thereof will be omitted. Although a plurality of the electric wires 8 are used in the present embodiment as illustrated in FIG. 4, only one electric wire 8 may be used.

Next, the terminal 6 will be described.

The terminal 6 is not limited to any particular terminal. In the present embodiment, the terminal 6 is a female terminal and crimped to the end of the electric wire 8. The terminal 6 is configured to be contained in the cavity 29 of the housing 3. Because a plurality of the electric wires 8 are used in the present embodiment, the number of the terminals 6 corresponds to the number of the electric wires 8.

The rubber stopper 7 will now be described.

The rubber stopper 7 is crimped to the terminal 6. The rubber stopper 7 serves to seal the terminal insertion hole 30 of the housing 3. Because a plurality of the electric wires 8 are used in the present embodiment, the number of the rubber stoppers 7 corresponds to the number of the electric wires 8. When only one electric wire 8 is used, only one rubber stopper 7 is used.

Next, the corrugated tube 20 will be described.

As illustrated in FIG. 4, the corrugated tube 20 serves to protect the electric wires 8 led from the cover 2. Because a known corrugated tube is used as the corrugated tube 20, detailed description thereof will be omitted.

The procedure for assembling the cover 2 and the housing 3 to each other will now be described.

First, the terminal 6, placed on the end of the electric wire 8 illustrated in FIG. 1, is inserted through the terminal insertion hole 30 (see FIG. 2) of the housing 3 and contained in the cavity 29. This brings the terminal 6 into engagement with the cavity lance 31 in the cavity 29 as illustrated in FIG. 2. As illustrated in FIG. 2, the front holder 4 is subsequently contained in the front holder container 32 in the cavity 29.

The cover 2 is then moved in the direction indicated by the arrow J in FIG. 2, so as to insert the housing 3 into the housing container 12 of the body 9 of the cover 2, thus assembling the cover 2 and the housing 3 to each other. As illustrated in FIG. 3, the assembling of the cover 2 and the housing 3 to each other is carried out until the front surface of the cover 2 abuts against the front surface of the housing 3. This abutment completes the assembling of the cover 2 and the housing 3 to each other.

Next, the procedure for fitting the body 9 and the lid 10 of the cover 2 to each other will be described.

First, prior to the fitting of the body 9 and the lid 10 to each other, a plurality of the electric wires 8 led from the housing 3 are bent as illustrated in FIG. 4. As illustrated in FIG. 4, the corrugated tube 20 is disposed to surround portions of the electric wires 8 led from the cover 2, and then one end of the corrugated tube 20 is assembled to the electric wire leading portion 13 of the body 9 of the cover 2.

The lid 10 of the cover 2 is subsequently rotated in the direction indicated by the arrow K in FIG. 4, with the hinge 11 of the cover 2 used as the pivot.

The situation where the hinge 11 is distorted in the course of fitting of the body 9 and the lid 10 to each other will now be described.

As already mentioned, distortion of the hinge 11 causes the lid 10 to be fitted to the body 9, with the lid 10 out of proper fitting alignment with the body 9 as illustrated in FIG. 5. In this case, as illustrated in FIG. 6, the distal end of the guide portion 14 of the body 9 (i.e., the distal end of the surface 17 parallel to the axis of the body) abuts against the guide receiving portion inclined surface 25 of the guide receiving portion 15 of the lid 10. In other words, the guide portion 14 of the body 9 comes into contact with the guide receiving portion 15 of the lid 10. This restricts the misalignment of the lid 10 in a perpendicular direction (i.e., the upward direction in FIG. 6) relative to the direction in which the body 9 and the lid 10 are fitted to each other (i.e., the front-rear direction in FIG. 6).

When the misalignment of the lid 10 is restricted in this manner, the second cover engaged portions 22 of the lid 10 are brought into proper engaging alignment with the second cover engaging portions 21 as illustrated in FIG. 7. Thus, the distal ends of the second cover engaged portions 22 will not abut against the corrugated tube 20.

When the lid 10 illustrated in FIG. 6 is pushed in the direction in which the lid 10 and the body 9 are to be fitted to each other (i.e., in the front-rear direction in FIG. 6), the distal end of the guide portion 14 of the body 9 comes into sliding contact with the guide receiving portion inclined surface 25 of the guide receiving portion 15 of the lid 10. The distal end of the guide portion 14 of the body 9 moves beyond the guide receiving portion inclined surface 25 of the guide receiving portion 15 of the lid 10. Then, the guide receiving portion inclined surface 25 of the guide receiving portion 15 comes into sliding contact with the guide inclined surface 16 of the guide portion 14. Thus, the distal end of the guide receiving portion 15 of the lid 10 is guided along the guide portion 14 of the body 9, bringing the lid 10 into proper fitting alignment with the body 9. Subsequently, the first cover engaging portion 18 comes into engagement with the first cover engaged portion 19, and the second cover engaging portions 21 come into engagement with the second cover engaged portions 22. This completes the rotation of the lid 10.

In this state, the guide receiving portion abutment surface 26 of the guide receiving portion 15 abuts against the housing container abutment surface 28 of the body 9 as illustrated in FIG. 8. Because the cover 2 according to the present embodiment is provided at its lid 10 with the guide receiving portion 15, the area where a portion of the lid 10 (i.e., the guide receiving portion abutment surface 26 of the guide receiving portion 15) comes into surface contact with a portion of the body 9 (i.e., the housing container abutment surface 28) is larger for the cover 2 according to the present embodiment than for a cover provided with no guide receiving portion 15. Thus, the distortion of the cover 2 caused by harness tension is prevented.

As a result of the above procedure, the fitting of the body 9 and the lid 10 of the cover 2 to each other is completed.

As described with reference to FIGS. 1 to 8, the present embodiments allow the body 9 and the lid 10 of the cover 2 to be fitted to each other without exercising care to prevent abutment of the distal end of the second cover engaged portion 22 of the lid 10 against the corrugated tube 20. Consequently, the present embodiment has the effect of enhancing the workability of fitting the body 9 and the lid 10 to each other.

The present invention increases the area where the guide receiving portion 15 comes into surface contact with a portion of the body 9 (i.e., the housing container abutment surface 28), thus preventing distortion of the cover 2 caused by harness tension. Consequently, the present embodiment has the effect of preventing distortion-induced disengagement of the cover 2 from the housing 3.

Embodiment 2

The present invention provides, in addition to the cover according to Embodiment 1, a cover according to Embodiment 2 described below.

Figure 9A:
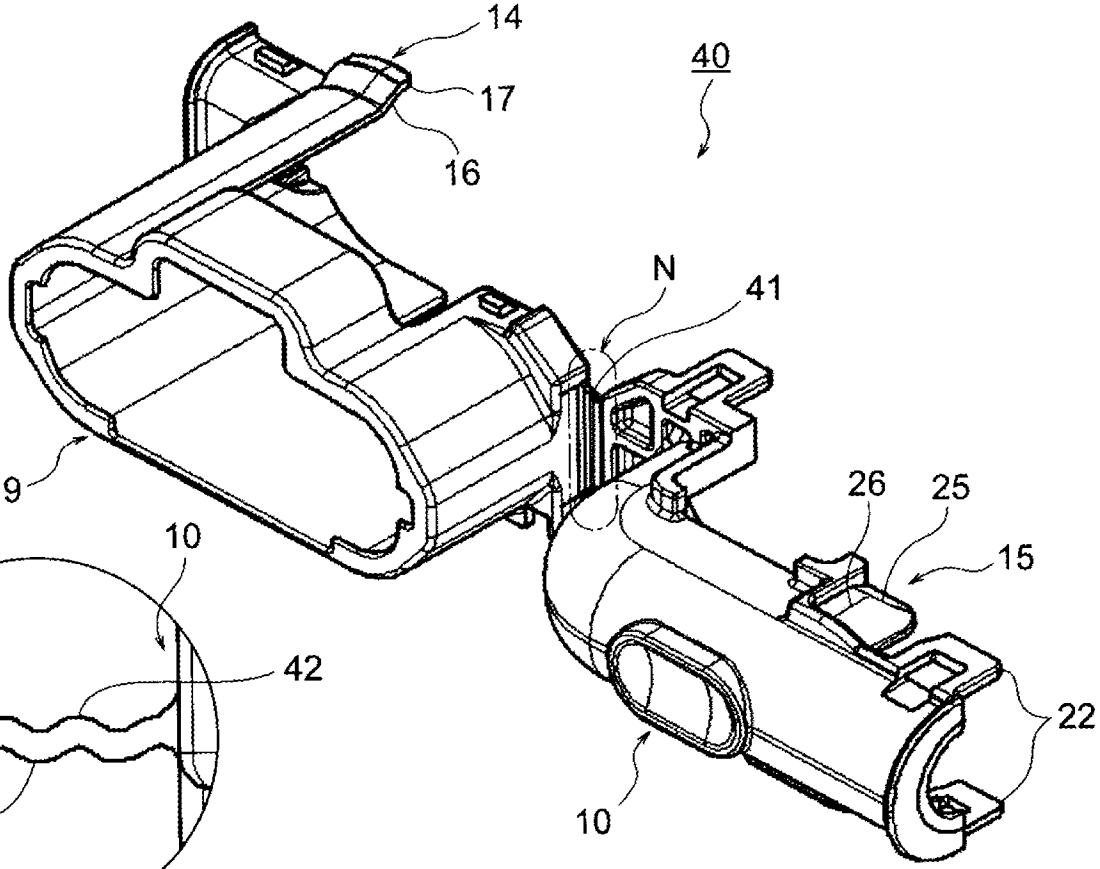
FIG. 9A is a perspective view of a cover according to Embodiment 2 of the present invention.
Figure 9B:
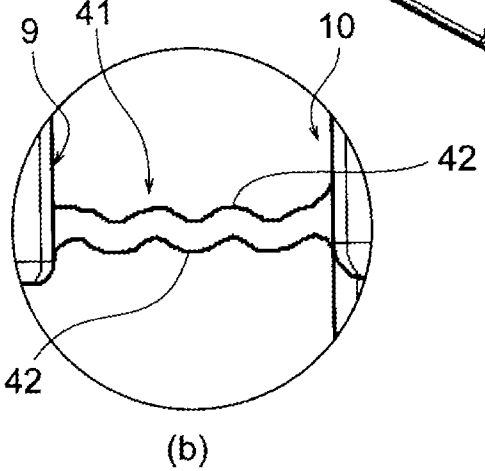
FIG. 9B is an enlarged plan view of a hinge surrounded by the broken line N in FIG. 9A.

FIGS. 9A and 9B illustrate the cover according to Embodiment 2 of the present invention.

FIG. 9A is a perspective view of the cover according to Embodiment 2 of the present invention. FIG. 9B is an enlarged plan view of a hinge surrounded by the broken line N in FIG. 9A.

The arrows in FIG. 9A indicate, by way of example, forward, rearward, leftward, and rightward directions.

The cover 40 according to the present embodiment has a configuration and a structure similar to those of the cover 2 (see FIG. 1) described in Embodiment 1, except for the hinge 41 illustrated in FIG. 9A. Accordingly, the description of the components of the cover 40 according to the present embodiment other than the hinge 41 will be omitted.

The hinge 41 according to the present embodiment is configured so that a portion of the hinge 41 extending between one widthwise end of the hinge 41 connected to the body 9 and the other widthwise end of the hinge 41 connected to the lid 10 (i.e., extending in the right-left direction in FIG. 9A) is protruded in the thickness direction of the hinge 41 (i.e., the front-rear direction in FIG. 9A). This portion will hereinafter be referred to as an "protrusion portion".

In the present embodiment, the protrusion portion 42 of the hinge 41 has a wave-like shape in which substantially arc-shaped sections are regularly continuous with each other as illustrated in FIG. 9B. The protrusion portion 42, however, is not limited to such a shape. Alternatively, the protrusion portion 42 may have, for example, a zigzag shape instead of the wave-like shape in which the substantially arc-shaped sections are regularly continuous with each other. The heights of peaks of the protrusion portion 42 may be identical or different. The substantially arc-shaped sections of the protrusion portion 42 may be irregularly continuous with each other.

As described with reference to FIGS. 9A and 9B, the protrusion portion 42 of the hinge 41 according to the present invention increases the rigidity of the hinge 41 so as to prevent distortion of the hinge 41 and more reliably fit the lid 10 and the body 9 to each other at proper fit positions. Thus, in fitting the lid 10 and the body 9 to each other, the distal end of the second cover engaged portion 22 of the lid 10 is more unlikely to abut against the corrugated tube 20. This means that the body 9 and the lid 10 are fitted to each other without exercising care to prevent abutment of the distal end of the second cover engaged portion 22 of the lid 10 against the corrugated tube 20. Consequently, the present embodiment has the effect of further enhancing the workability of fitting the body 9 and the lid 10 to each other.

According to the present invention, the hinge 41 provided with the protrusion portion 42 has a longer total length than a hinge provided with no protrusion portion 42, thus enabling stress distribution. This prevents distortion of the hinge 41. Consequently, the present embodiment has the effect of preventing distortion-induced breakage of the hinge 41.

Embodiment 3

The present invention provides, in addition to the covers according to Embodiments 1 and 2, a cover according to Embodiment 3 described below.

FIGS. 10 to 13 illustrate the cover according to Embodiment 3 of the present invention.

Figure 10:
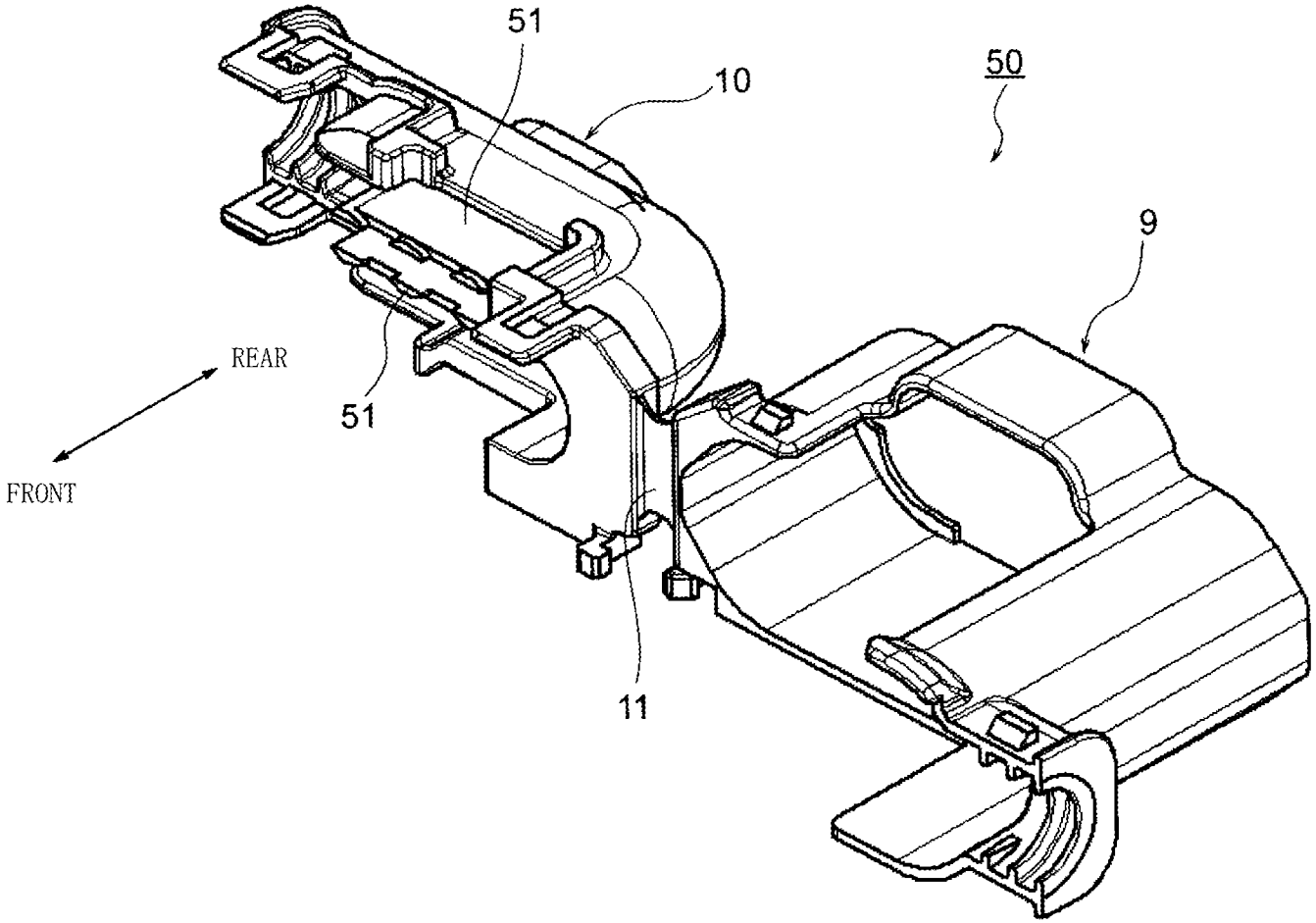
FIG. 10 is a perspective view of a cover according to Embodiment 3 of the present invention.
Figure 11:
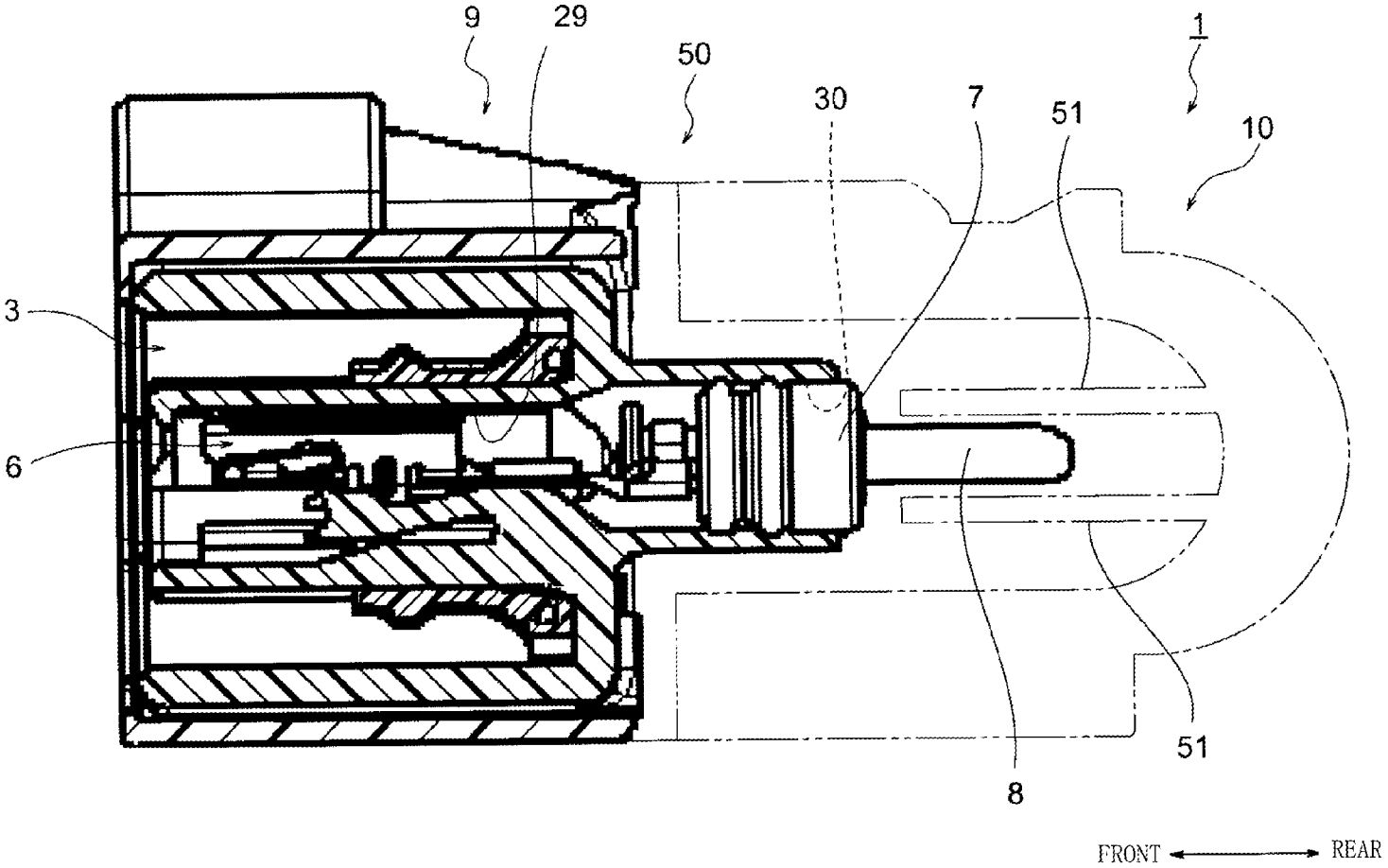
FIG. 11 is a cross-sectional view of the connector, illustrating how the body and lid of the cover are fitted to each other, with abutment portions yet to abut against a rubber stopper.
Figure 12:
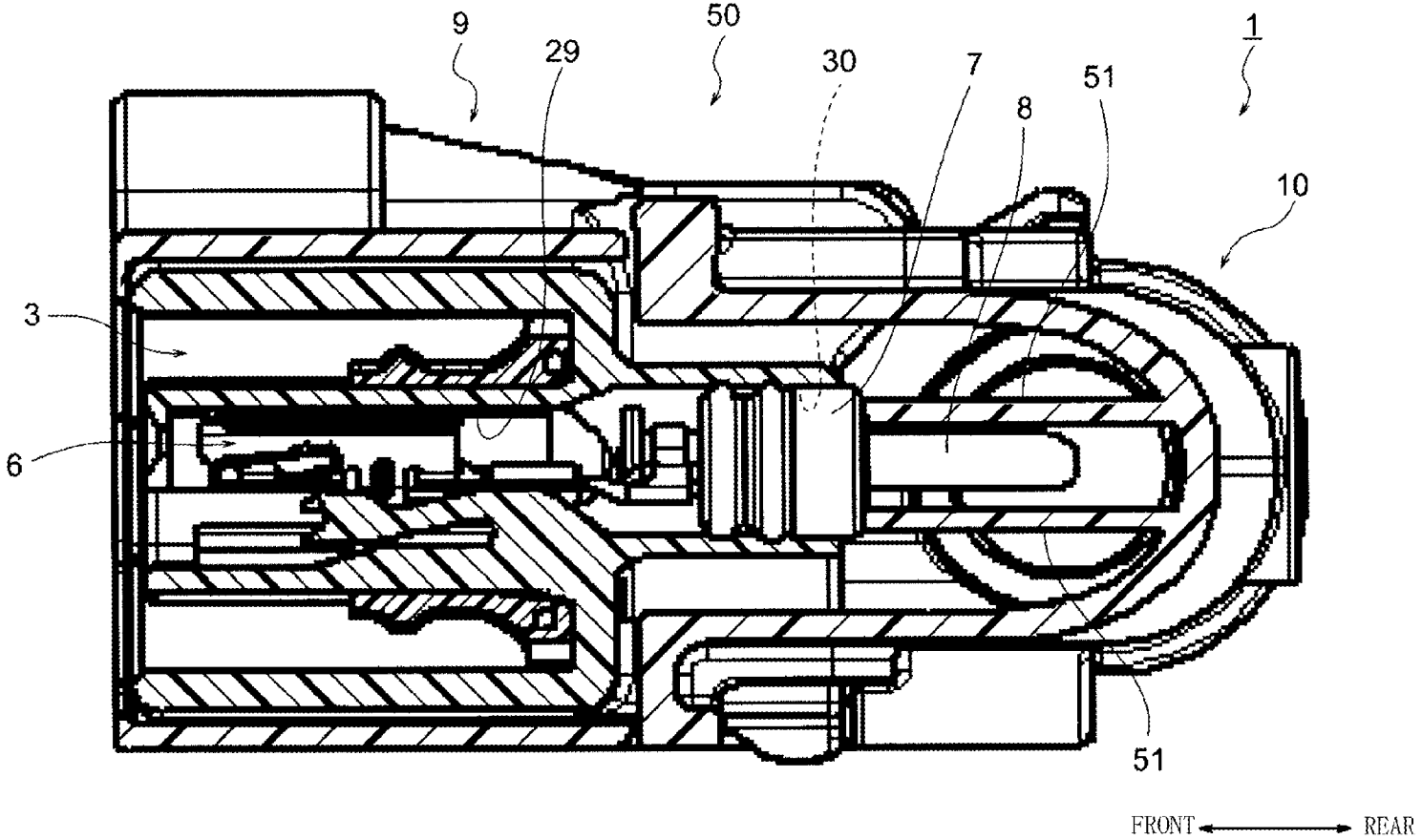
FIG. 12 is a cross-sectional view of the connector, illustrating how the body and lid of the cover are fitted to each other, with the abutment portions abutting against the rubber stopper.
Figure 13:
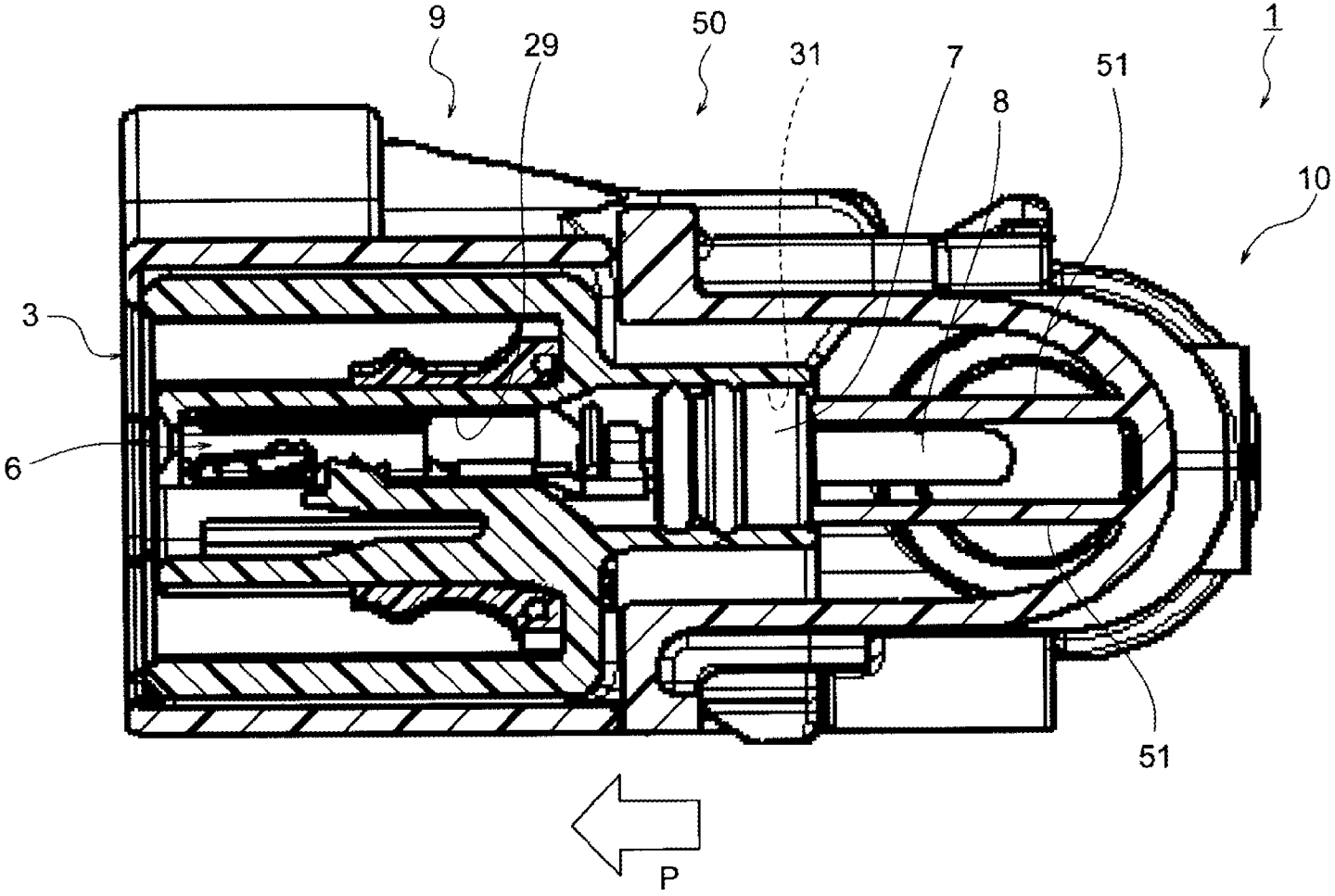
FIG. 13 is a cross-sectional view of the connector, illustrating how the body and lid of the cover are fitted to each other, with the body and lid fitted to each other.

FIG. 10 is a perspective view of the cover according to Embodiment 3 of the present invention. FIG. 11 is a cross-sectional view of the connector, illustrating how the body and lid of the cover are fitted to each other, with abutment portions yet to abut against the rubber stopper. FIG. 12 is a cross-sectional view of the connector, illustrating how the body and lid of the cover are fitted to each other, with the abutment portions abutting against the rubber stopper. FIG. 13 is a cross-sectional view of the connector, illustrating how the body and lid of the cover are fitted to each other, with the body and lid fitted to each other.

The arrows in FIGS. 10 to 12 indicate, by way of example, forward and rearward directions.

The cover 50 according to the present embodiment has a configuration and a structure similar to those of the cover 2 (see FIG. 1) described in Embodiment 1, except for the abutment portions 51 illustrated in FIG. 10. Accordingly, the description of the components of the cover 50 according to the present embodiment other than the abutment portions 51 will be omitted.

As illustrated in FIG. 10, the abutment portions 51 protrude from the inner surface of the lid 10 of the cover 50 along the axis of the cover (i.e., the front-rear direction in FIG. 10). With the body 9 and the lid 10 fitted to each other, the distal ends of the abutment portions 51 constantly abut against the rubber stopper 7 illustrated in FIGS. 11 to 13. With the body 9 and the lid 10 fitted to each other, the abutment portions 51 abut against the rubber stopper 7 such that the abutment portions 51 press the rubber stopper 7. When the rubber stopper 7 illustrated in FIGS. 11 to 13 is plural in number, the abutment portions 51 abut against all the rubber stoppers 7. The abutment portions 51, however, are not limited to such a configuration. Alternatively, the abutment portions 51 may abut against one of the rubber stoppers 7, for example. When the rubber stopper 7 is singular in number, the abutment portions 51 abut against the single rubber stopper 7.

The procedure for fitting the body 9 and the lid 10 of the cover 50 to each other will now be described. Because assembling the cover 50 and the housing 3 to each other is similar to that described in Embodiment 1, description thereof will be omitted.

Using, as a pivot, the hinge 11 of the cover 50 illustrated in FIG. 10, the lid 10 is rotated such that the lid 10 is brought to the state illustrated in FIG. 11. In this state, the terminal 6 illustrated in FIGS. 11 and 12 is inserted only halfway. Thus, the rear surface of the rubber stopper 7 attached to the terminal 6 is located outside the rear plane of the terminal insertion hole 30.

Further rotation of the lid 10 in the direction in which the lid 10 is to be fitted to the body 9 (i.e., the forward direction in FIG. 11) causes the distal ends of the abutment portions 51 to abut against the rear surface of the rubber stopper 7 as illustrated in FIG. 12.

Subsequent further rotation of the lid 10 in the direction in which the lid 10 is to be fitted to the body 9 (i.e., the forward direction in FIG. 11) brings the first cover engaging portion 18 (see FIG. 10) into engagement with the first cover engaged portion 19 (see FIG. 10), and brings the second cover engaging portions 21 (see FIG. 10) into engagement with the second cover engaged portions 22 (see FIG. 10). This completes the fit between the body 9 and the lid 10.

The fit between the body 9 and the lid 10 causes the distal ends of the abutment portions 51 to abut against the rear surface of the rubber stopper 7. Thus, as illustrated in FIG. 13, the distal ends of the abutment portions 51 press the rubber stopper 7 in the direction indicated by the arrow P in FIG. 13. Concurrently with this, the terminal 6 is also pressed in the direction indicated by the arrow P in FIG. 13, and is thus brought to a proper position in the cavity 29.

As described with reference to FIGS. 10 to 13, the present invention not only achieves effects similar to those of Embodiment 1, but also has the effect of preventing halfway insertion of the terminal 6, because the abutment portions 51 are provided inside the lid 10.

According to the present invention, in fitting the lid 10 to the body 9, halfway insertion of the terminal 6 is detected by pressing of the rubber stopper 7 by the abutment portions 51. This eliminates the need for any front holder. Accordingly, the present embodiment reduces the number of components and the number of assembly cycles, and thus has the effect of reducing cost.

According to the present invention, once the lid 10 is fitted to the body 9, the abutment portions 51 constantly press the rubber stopper 7, thus preventing backlash of the cover 50 if the connector 1 is vibrated. Consequently, the present embodiment has the effect of preventing generation of unusual noises caused by backlash of the cover 50.

Embodiment 4

The present invention provides, in addition to the covers according to Embodiments 1 to 3, a cover according to Embodiment 4 described below.

FIGS. 14 to 18 illustrate the cover according to Embodiment 4 of the present invention.

Figure 14:
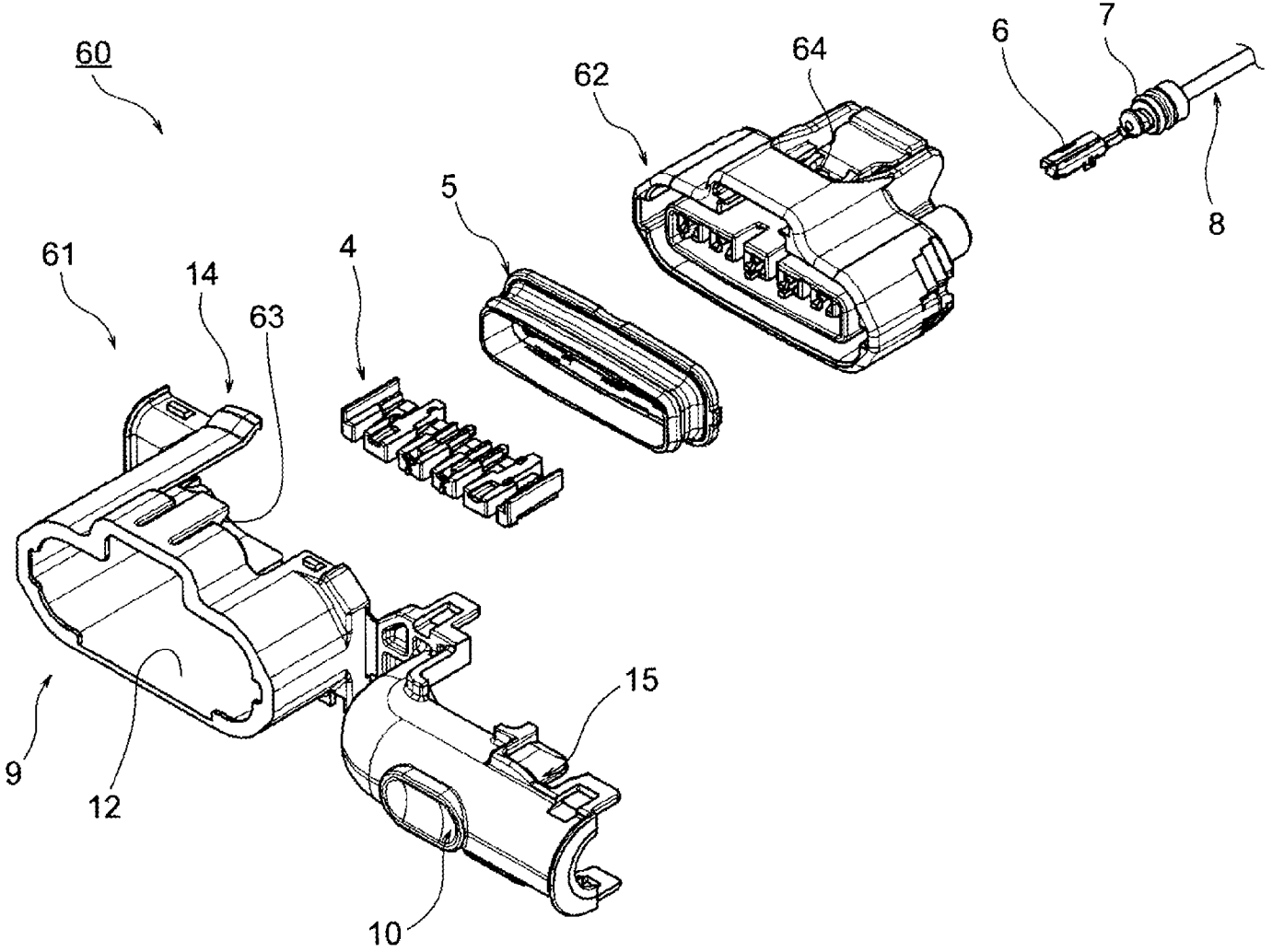
FIG. 14 is an exploded perspective view of a connector according to Embodiment 4 of the present invention, including an inventive cover.
Figure 15:
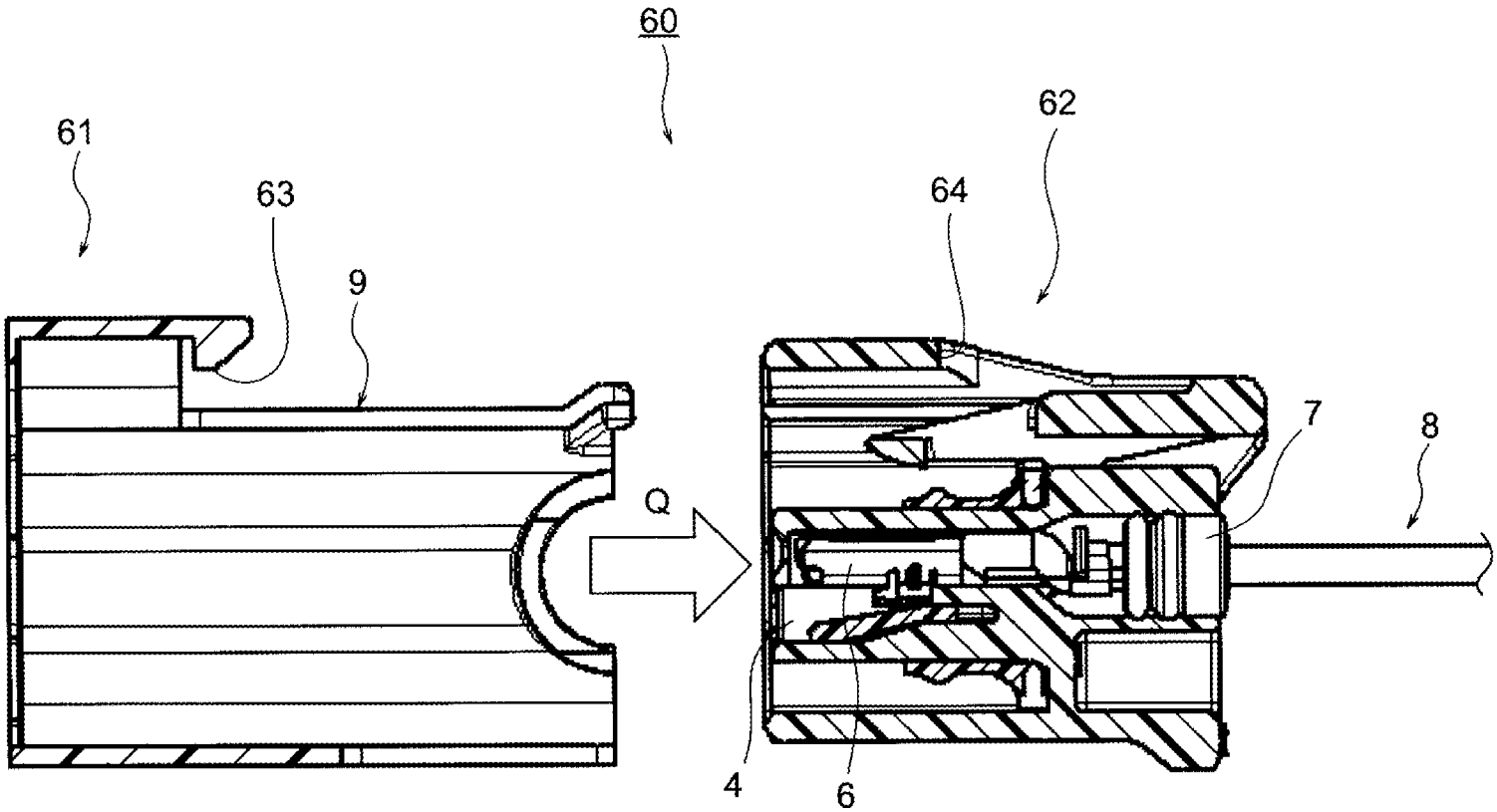
FIG. 15 is a cross-sectional view of the cover and a connector housing, illustrating how the cover and the connector housing are assembled to each other.
Figure 16:
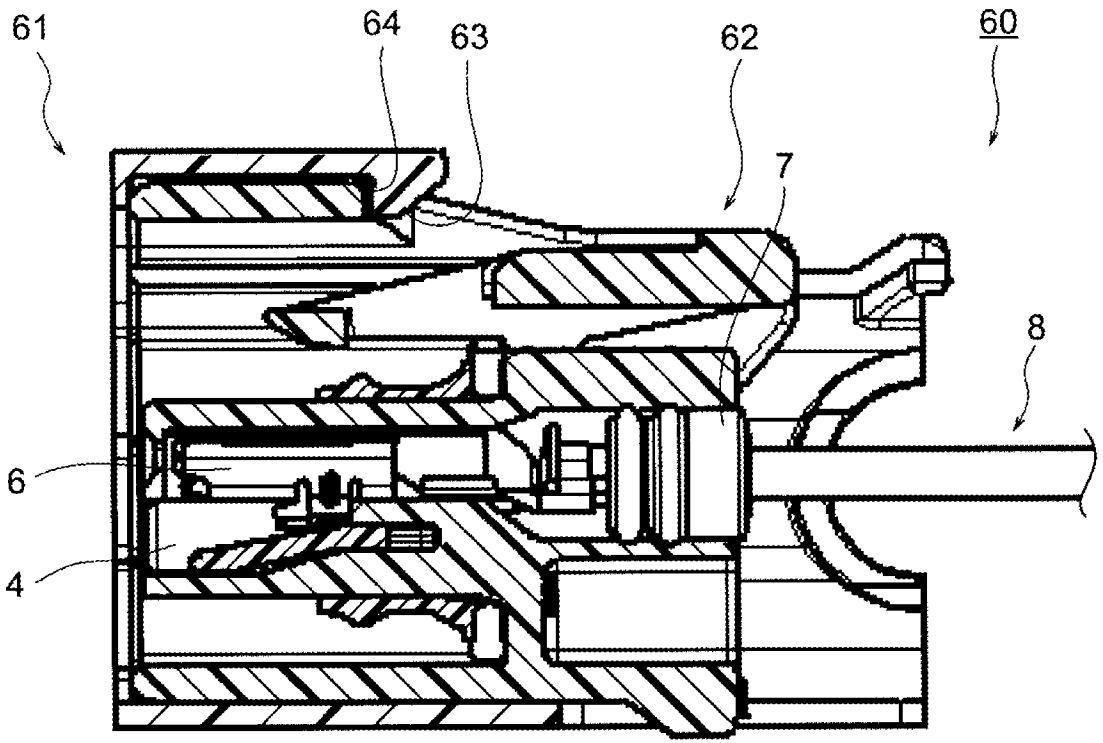
FIG. 16 is a cross-sectional view of the cover and the connector housing assembled to each other.
Figure 17:
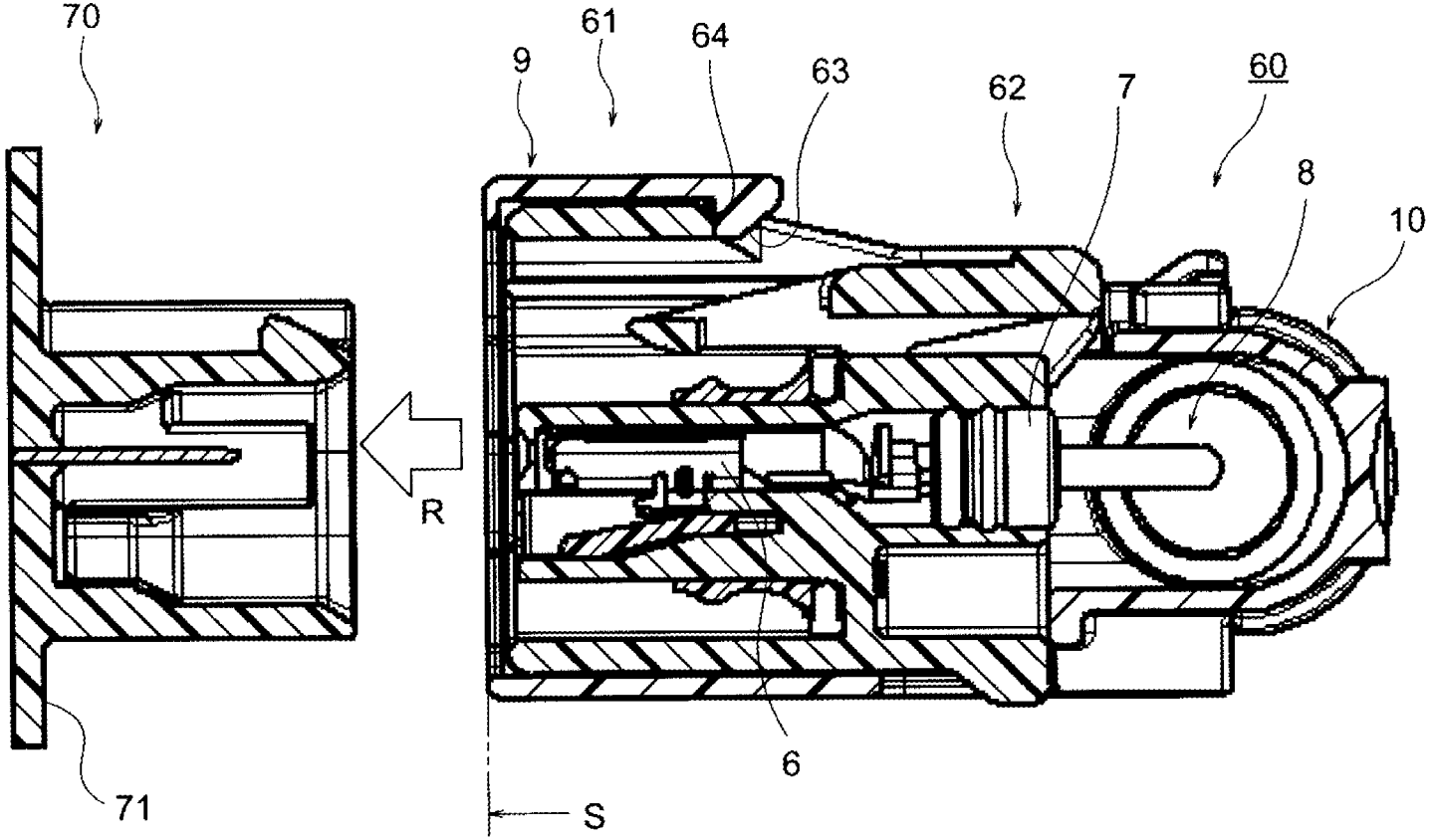
FIG. 17 is a cross-sectional view of the connector and a counterpart connector yet to be fitted to each other, illustrating how the connector and the counterpart connector are fitted to each other.
Figure 18:
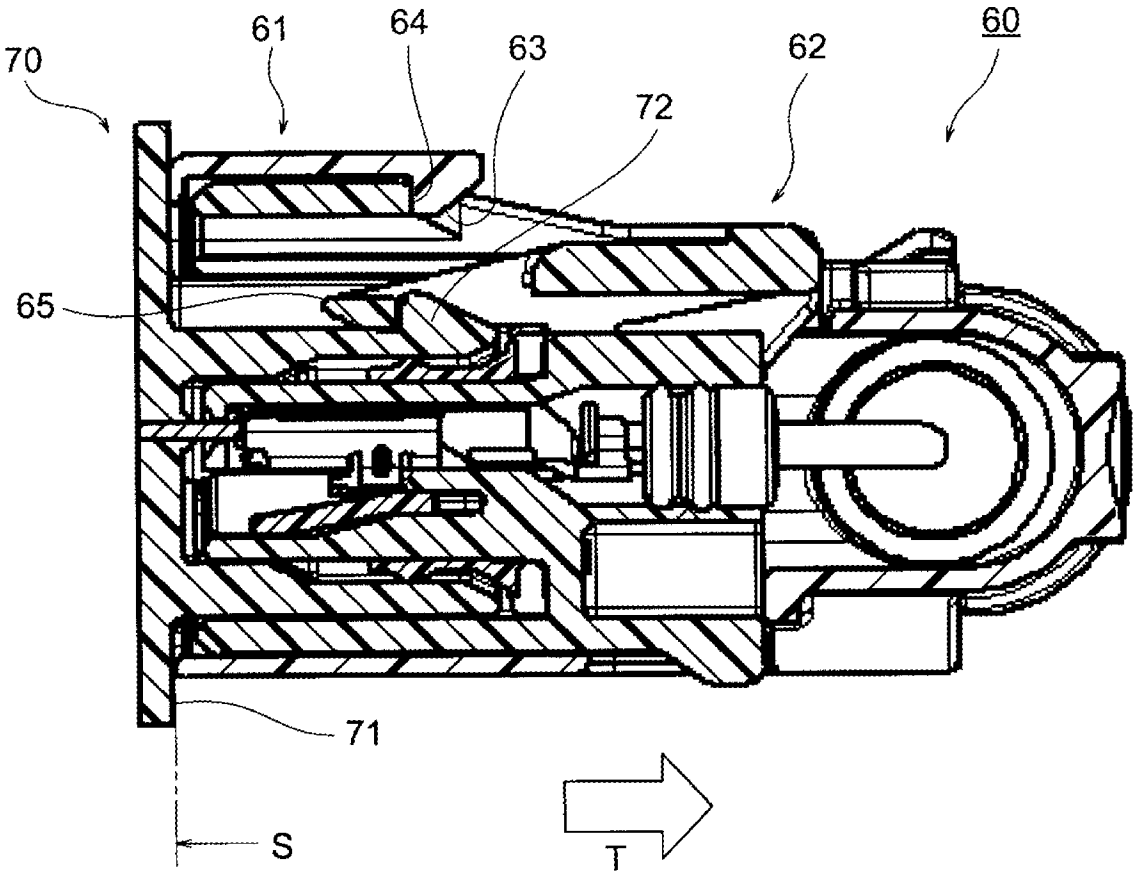
FIG. 18 is a cross-sectional view of the connector and the counterpart connector fitted to each other, illustrating how the connector and the counterpart connector are fitted to each other.
Figure 19:
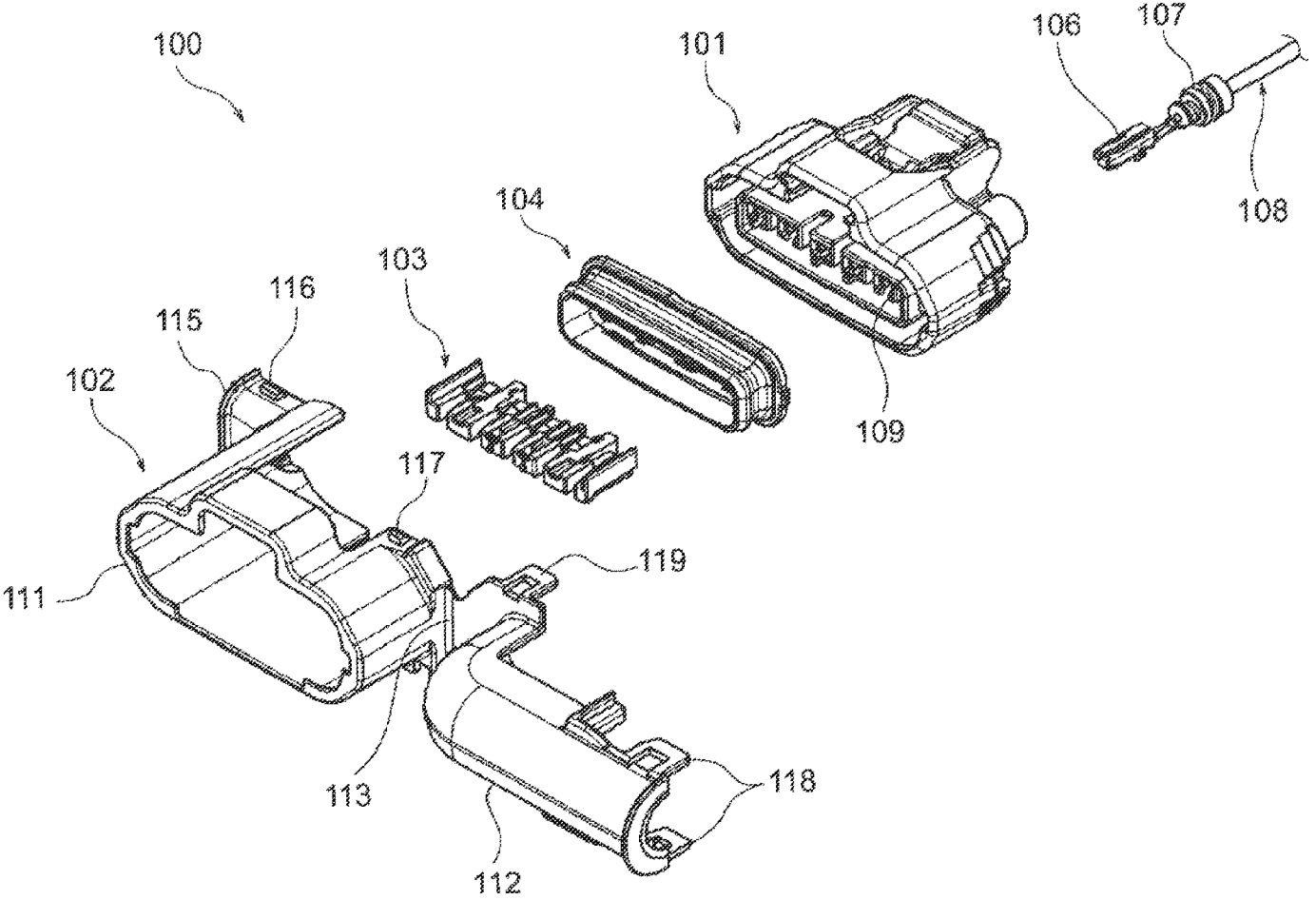
FIG. 19 RELATED ART
FIG. 19 is an exploded perspective view of a connector, clarifying the object of the invention.
Figure 20:
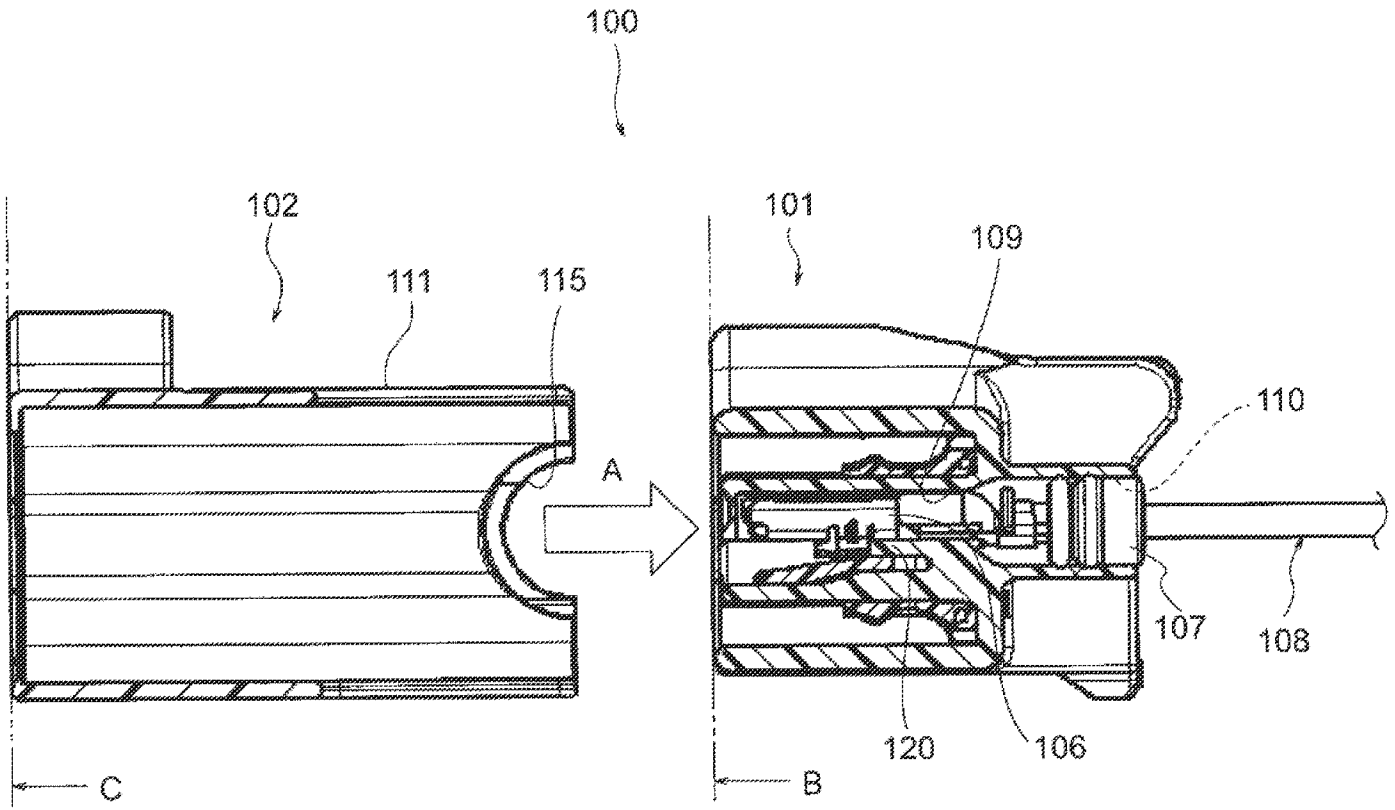
FIG. 20 RELATED ART
FIG. 20 is a cross-sectional view of a cover and a housing, illustrating how the cover and the housing are assembled to each other and clarifying the object of the invention.
Figure 21:
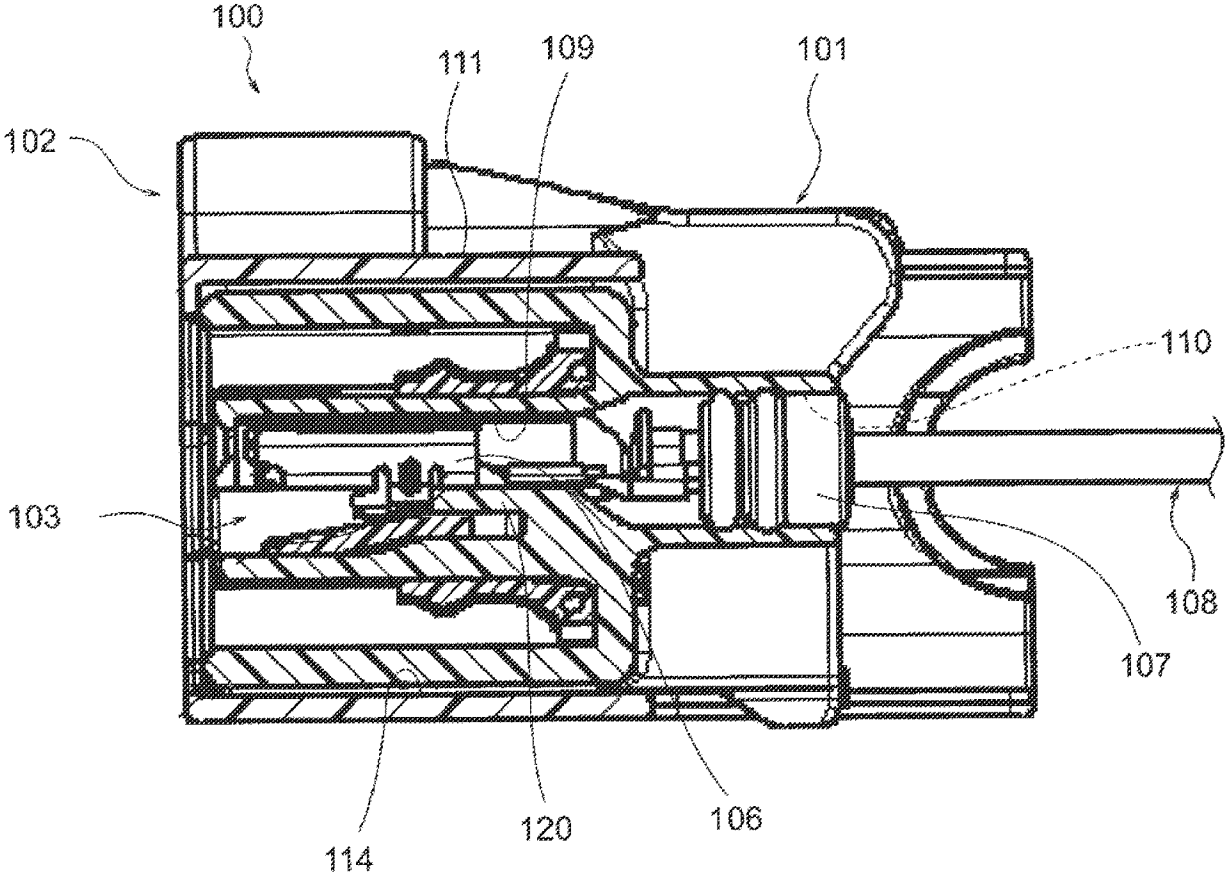
FIG. 21 RELATED ART
FIG. 21 is a cross-sectional view of the cover and the housing assembled to each other, clarifying the object of the invention.
Figure 22:
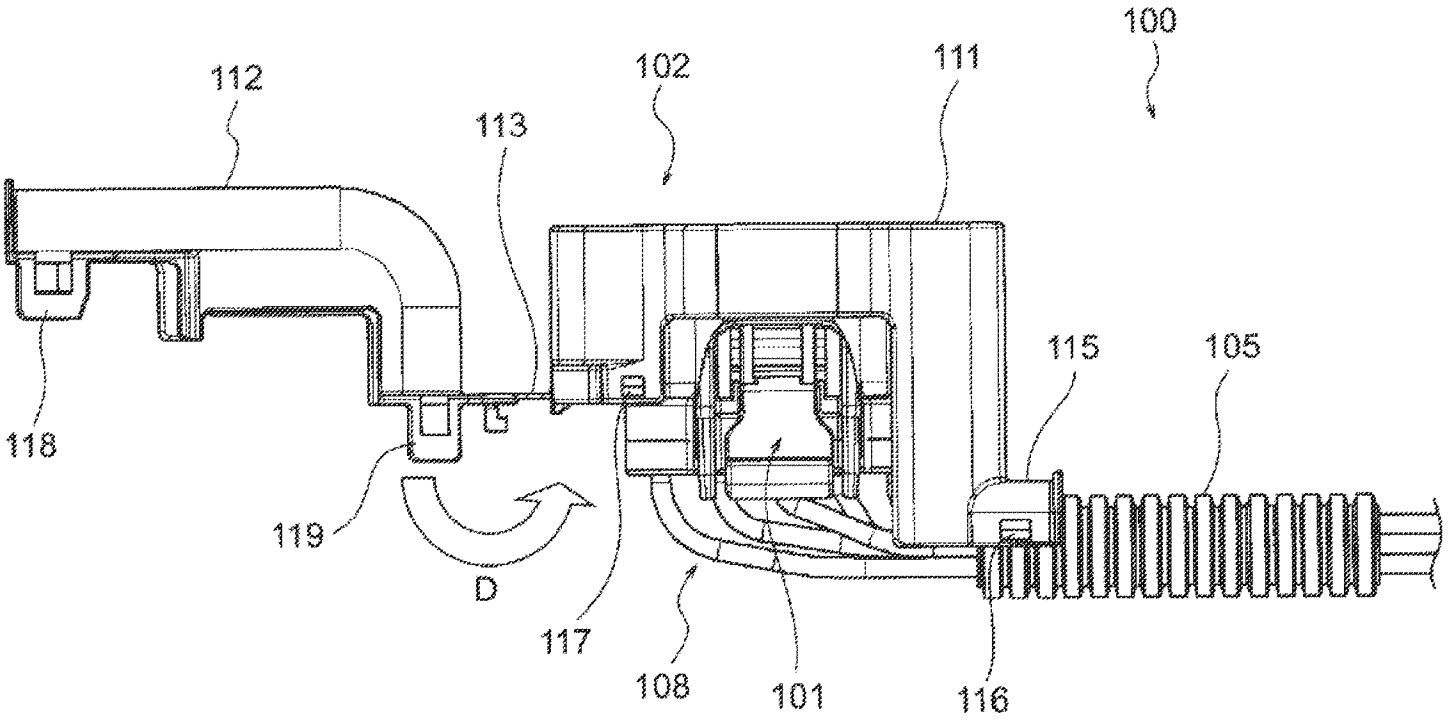
FIG. 22 RELATED ART
FIG. 22 is a plan view of the connector, illustrating how the body and lid of the cover are fitted to each other and clarifying the object of the invention.
Figure 23:
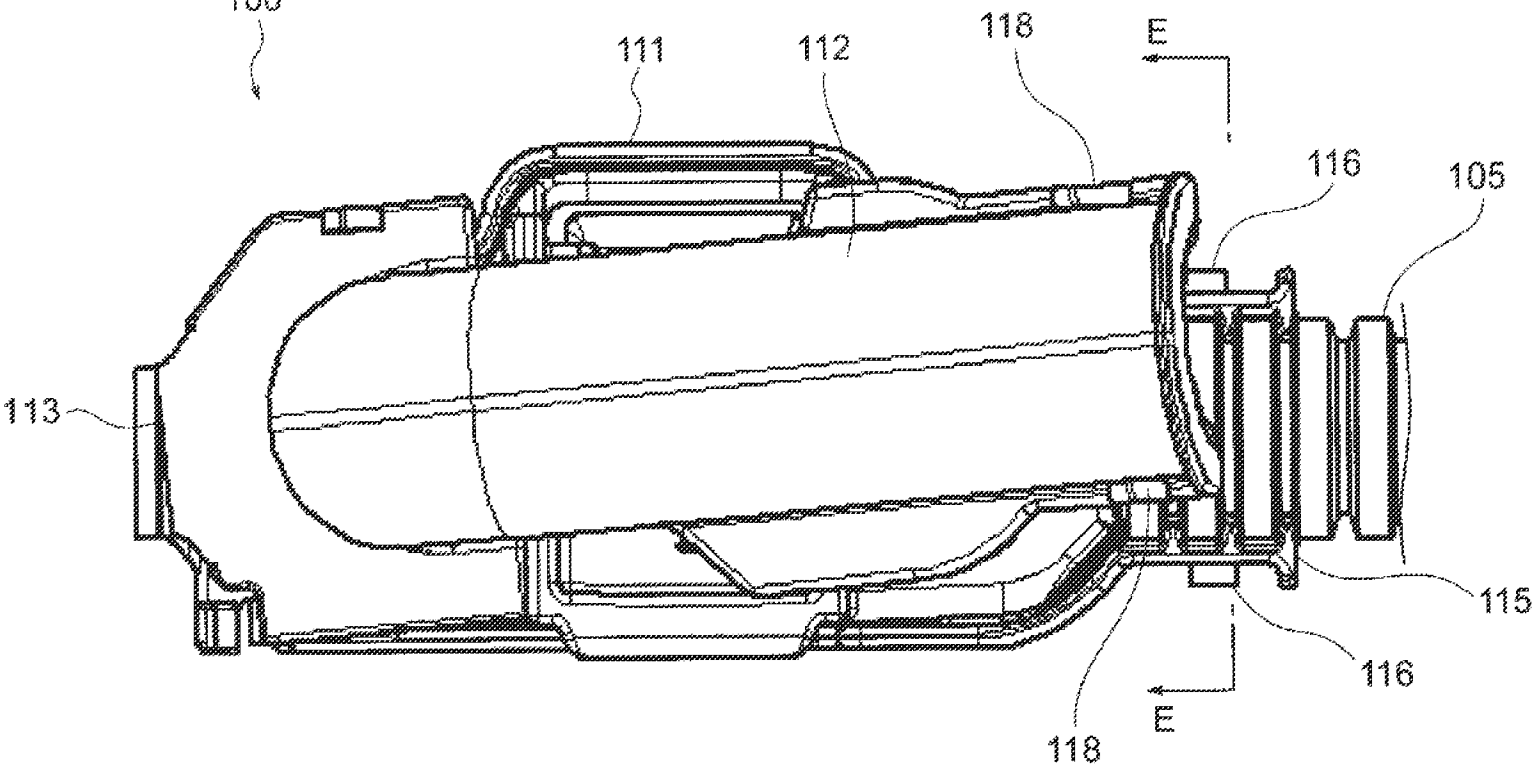
FIG. 23 RELATED ART
FIG. 23 is a side view of the connector viewed from the lid of the cover, clarifying the object of the invention.
Figure 24:
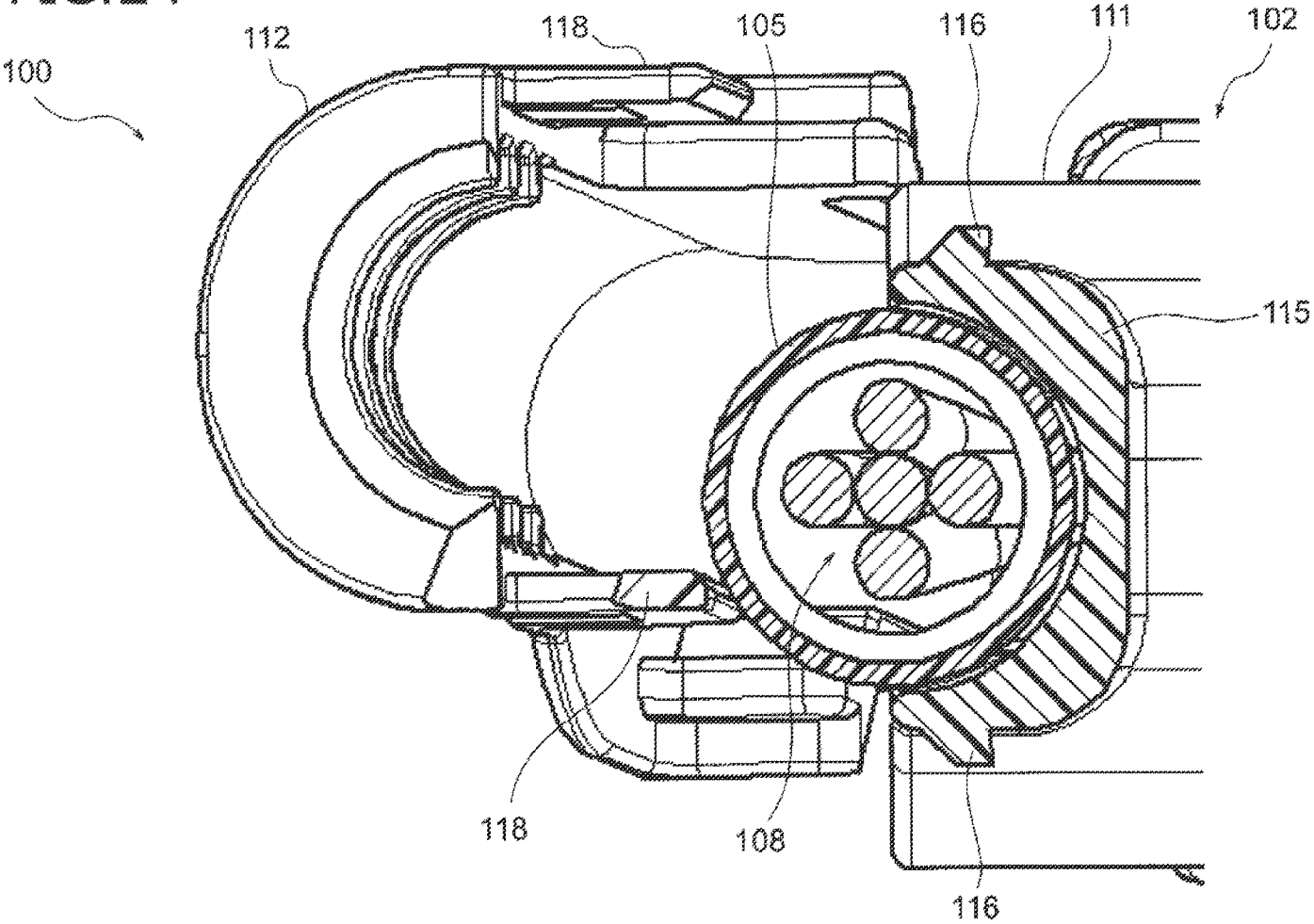
FIG. 24 RELATED ART
FIG. 24 is a cross-sectional view taken along the line E-E in FIG. 23, clarifying the object of the invention.
Figure 25A:
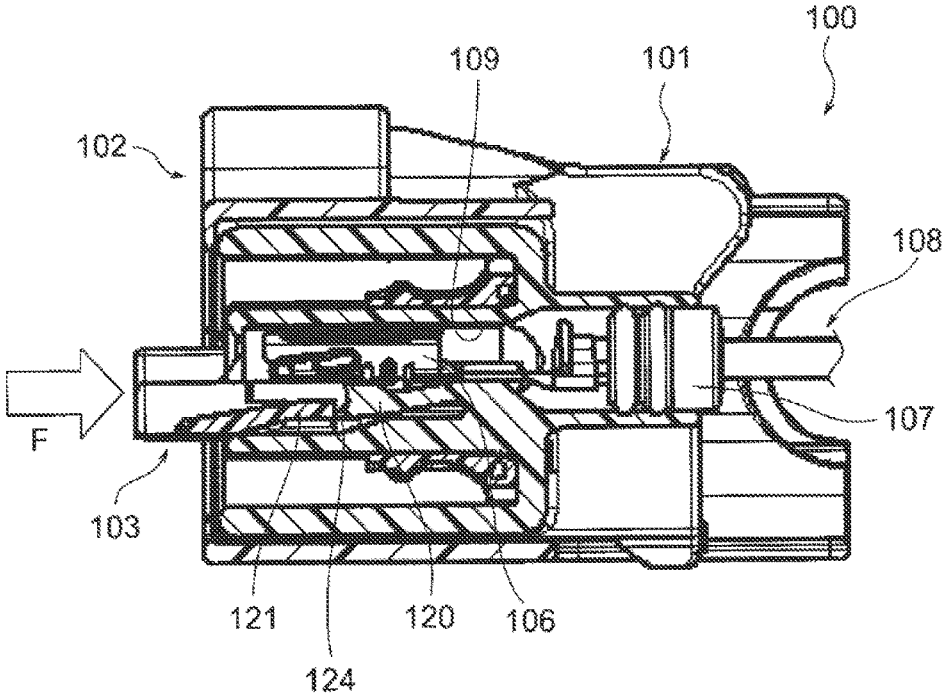
FIG.25A RELATED ART
FIG. 25A is a cross-sectional view of the connector, illustrating how halfway insertion of a terminal is detected and clarifying the object of the invention.
Figure 25B:
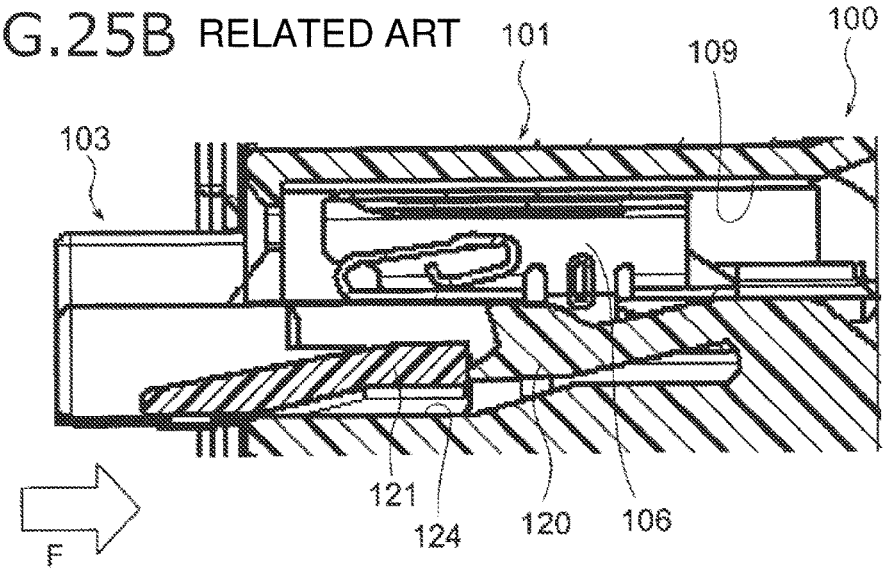
FIG.25B RELATED ART
FIG. 25B is an enlarged cross-sectional view of a cavity and its surrounding region illustrated in FIG. 25A, clarifying the object of the invention.
Figure 26:
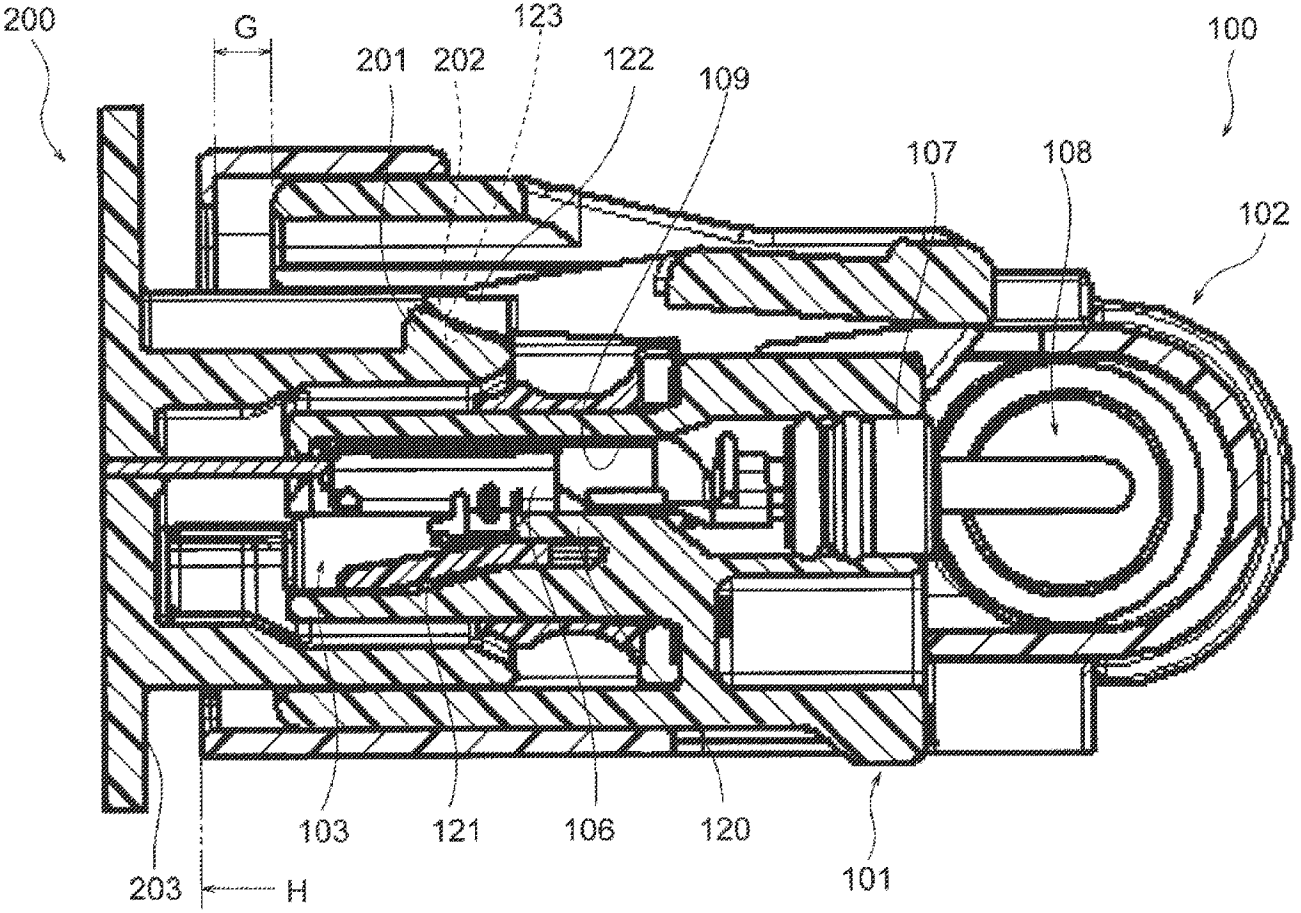
FIG. 26 RELATED ART
FIG. 26 is a cross-sectional view of the connector and a counterpart connector yet to be fitted to each other, clarifying the object of the invention.
Figure 27:
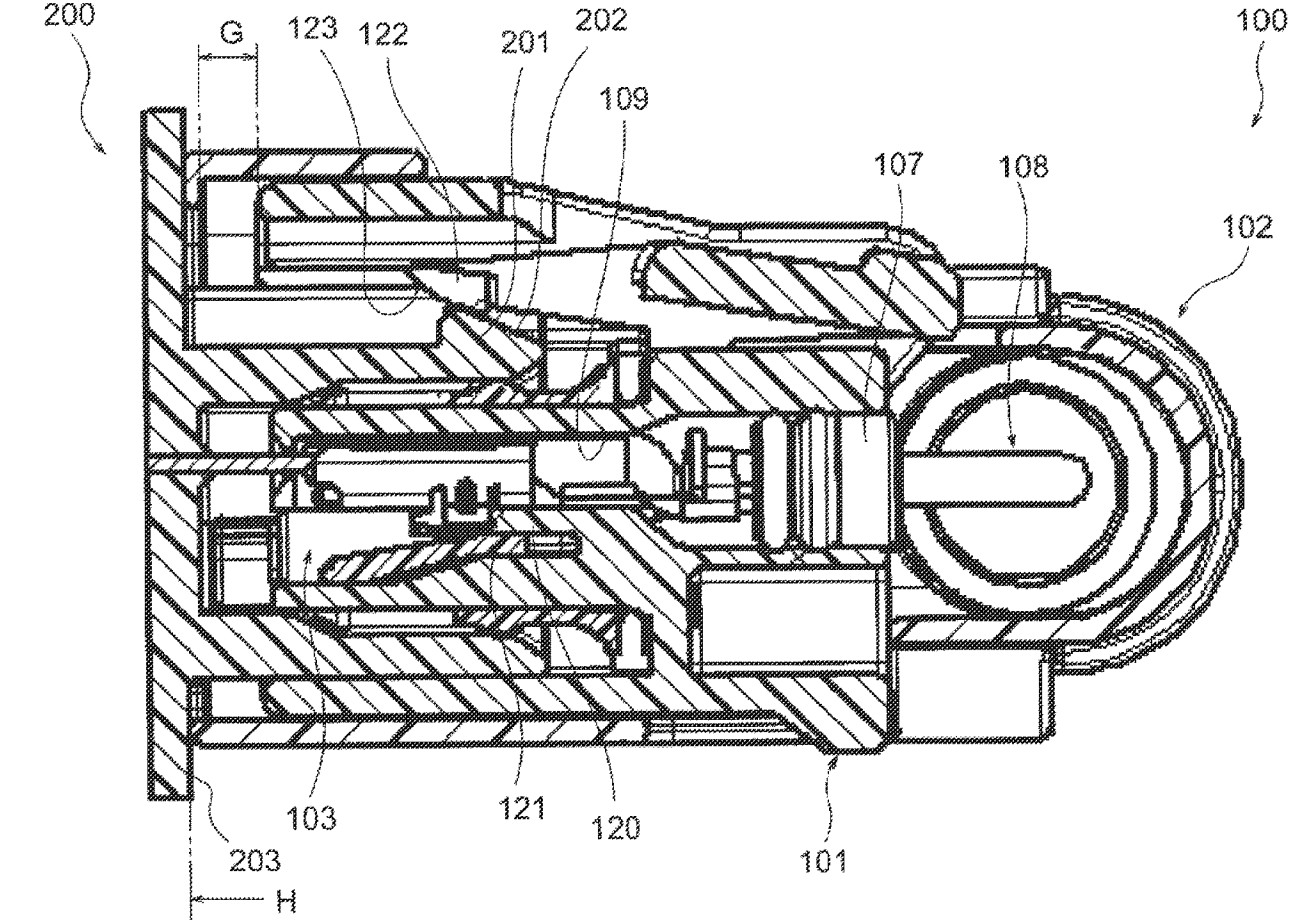
FIG. 27 RELATED ART
FIG. 27 is a cross-sectional view of the connector and the counterpart connector fitted to each other, clarifying the object of the invention.

FIG. 14 is an exploded perspective view of a connector according to Embodiment 4 of the present invention, including an inventive cover. FIG. 15 is a cross-sectional view of the cover and a connector housing, illustrating how the cover and the connector housing are assembled to each other. FIG. 16 is a cross-sectional view of the cover and the connector housing assembled to each other. FIG. 17 is a cross-sectional view of the connector according to Embodiment 4 and a counterpart connector yet to be fitted to each other, illustrating how the connector according to Embodiment 4 and the counterpart connector are fitted to each other. FIG. 18 is a cross-sectional view of the connector according to Embodiment 4 and the counterpart connector fitted to each other, illustrating how the connector according to Embodiment 4 and the counterpart connector are fitted to each other.

The cover 61 according to the present embodiment, which is included in the connector 60, has a configuration and a structure similar to those of the cover 2 (see FIG. 1) described in Embodiment 1, except for an engaging protrusion 63 illustrated in FIGS. 14 to 18. Accordingly, the description of the components of the cover 61 according to the present embodiment other than the engaging protrusion 63 will be omitted.

The housing 62 according to the present embodiment has a configuration and a structure similar to those of the housing 3 (see FIG. 1) described in Embodiment 1, except for an engaged portion 64 illustrated in FIGS. 14 to 18. Accordingly, the description of the components of the housing 62 according to the present embodiment other than the engaged portion 64 will be omitted.

As illustrated in FIGS. 14 to 18, the cover 61 is provided with the engaging protrusion 63. The engaging protrusion 63 is provided on the upper surface of the housing container 12 of the body 9, and is engageable with the engaged portion 64 of the housing 62 (which will be described below).

As illustrated in FIGS. 14 to 18, the upper surface of the housing 62 is provided with the engaged portion 64. As illustrated in FIG. 18, the housing 62 is provided with an engaging arm 65 engageable with an engaged portion 72 of the counterpart connector 70 (which will be described below).

The procedure for assembling the cover 61 and the housing 62 to each other will now be described.

The assembling of the cover 61 and the housing 62 to each other is basically similar to the assembling of the cover 2 and the housing 3 to each other in Embodiment 1. The assembling in Embodiment 4 differs from the assembling in Embodiment 1 in that the cover 61 is moved in the direction indicated by the arrow Q in FIG. 15 to assemble the cover 61 and the housing 62 to each other, thus bringing the engaging protrusion 63 of the cover 61 into engagement with the engaged portion 64 of the housing 62 as illustrated in FIG. 16. In other words, the present embodiment allows the body 9 of the cover 61 and the housing 62 to be in provisional engagement with each other. Thus, backlash in the depth direction (i.e., the front-rear direction in FIGS. 14 to 18) occurs only between two components, i.e., the cover 61 and the housing 62, so that no further backlash in the depth direction will occur when the lid 10 is fitted to the body 9.

As a result of the above procedure, the assembling of the cover 61 and the housing 62 to each other is completed.

How the connector 60 and the counterpart connector 70 are fitted to each other will now be described.

The counterpart connector 70 is to be connected with the connector 60, and is a male connector in the present embodiment.

After the body 9 and the lid 10 of the cover 61 are fitted to each other, the connector 60 is moved in the direction indicated by the arrow R in FIG. 17 to fit the connector 60 to the counterpart connector 70. Thus, when the front surface of the cover 61 (i.e., the surface indicated by the imaginary line S in FIG. 17) abuts against a cover abutment surface 71 of the counterpart connector 70, the engaging protrusion 63 of the cover 61 is in engagement with the engaged portion 64 of the housing 62, thus preventing the housing 62 from moving backward in the direction indicated by the arrow T in FIG. 18. Consequently, the engaging arm 65 of the housing 62 is reliably brought into engagement with the engaged portion 72 of the counterpart connector 70.

As a result of the above procedure, the fitting of the connector 60 and the counterpart connector 70 to each other is completed.

As described with reference to FIGS. 14 to 18, the present invention not only achieves effects similar to those of Embodiment 1, but also has the effect of preventing backlash in the depth direction, thus reliably engaging the engaging arm 65 of the connector 60 with the engaged portion 72 of the counterpart connector 70.

The present invention further has the effect of reliably fitting the connector 60 to the counterpart connector 70, thus preventing loosening of the fit between the connector 60 and the counterpart connector 70.

It should naturally be appreciated that various modifications may be made to the present invention without departing from the scope of the invention.

As described in Embodiments 1 to 4, the covers 2, 40, 50, and 61 are each provided at its body 9 with the guide portion 14, and provided at its lid 10 with the guide receiving portion 15. The present invention, however, is not limited to this configuration. Alternatively, the body 9 may be provided with the guide receiving portion 15, and the lid 10 may be provided with the guide portion 14.

As described in Embodiments 1 to 4, the body 9 and the lid 10 of each of the covers 2, 40, 50, and 61 are connected to each other with the hinge 11 or 41 so as to be integral with each other. The present invention, however, is not limited to this configuration. Alternatively, the body 9 and the lid 10 may be separate from each other.

As described in Embodiment 4, the cover 61 is provided with the engaging protrusion 63, and the housing 62 is provided with the engaged portion 64. The present invention, however, is not limited to this configuration. Alternatively, the cover 61 may be provided with the engaged portion 64, and the housing 62 may be provided with the engaging protrusion 63.

What is claimed is:

1. A cover comprising:

a body configured to be attached to a housing containing a terminal connected to an end portion of an electric wire, the body being provided with an electric wire leading portion which leads out the electric wire pulled out from the housing; and a lid configured to be fitted to the body, wherein a guide receiving portion is provided on an outer surface of a distal end of one of the lid and the body, the guide receiving portion being provided with an inclined surface inclined toward an inner surface of the guide receiving portion along a direction in which the lid and the body are fitted to each other; and wherein a guide portion is provided on a distal end of the other of the lid and the body, the guide portion being configured to guide a distal end of the guide receiving portion, the guide portion protruding outward perpendicularly to the direction in which the lid and the body are fitted to each other, the guide portion being provided with an inclined surface on an inner surface of the distal end of the other of the lid and the body, the inclined surface of the guide portion being inclined outward along the direction in which the lid and the body are fitted to each other.

2. The cover according to claim 1, further comprising:

a hinge connecting the body and the lid, wherein a portion of the hinge extending from one end to the other end of the hinge in a width direction of the hinge which traverses over the body and the lid is protruded in a thickness direction of the hinge.

3. The cover according to claim 1, wherein the lid is provided at its inner surface with an abutment portion configured to abut against an elastic member on the terminal when the body and the lid are fitted to each other.

4. The cover according to claim 1, wherein the body of the cover is provided with an engaging protrusion, and wherein the housing is provided with an engaged portion configured to be engaged with the engaging protrusion.

5. A connection structure of a housing and a cover, the connection structure comprising:

the housing configured to contain a terminal connected to an end portion of an electric wire; and the cover comprising:

a body configured to be fitted to the housing and configured to lead out the electric wire pulled out from the housing, and a lid to configured to be engaged with the body, wherein a guide receiving portion is provided on an outer surface of a distal end of one of the lid and the body of the cover, the guide receiving portion being provided with an inclined surface inclined toward an inner surface of the guide receiving portion along a direction in which the lid and the body are brought into engagement with each other; and wherein a guide portion is provided on a distal end of the other of the lid and the body, the guide portion being configured to guide a distal end of the guide receiving portion, the guide portion protruding outward perpendicularly to the direction in which the lid and the body are brought into engagement with each other, the guide portion being provided with an inclined surface on an inner surface of the distal end of the other of the lid and the body, the inclined surface of the guide portion being inclined outward along the direction in which the lid and the body are brought into engagement with each other.

* * * * *